US006999381B2

(12) United States Patent
Fujisawa et al.

(10) Patent No.: US 6,999,381 B2
(45) Date of Patent: Feb. 14, 2006

(54) ELECTRONIC DEVICE, RECEPTION CONTROL METHOD FOR AN ELECTRONIC DEVICE, AND RECEPTION CONTROL PROGRAM FOR AN ELECTRONIC DEVICE

(75) Inventors: Teruhiko Fujisawa, Shiejiri (JP); Isao Oguchi, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 322 days.

(21) Appl. No.: 10/371,384

(22) Filed: Feb. 21, 2003

(65) Prior Publication Data

US 2003/0174584 A1 Sep. 18, 2003

(30) Foreign Application Priority Data

Feb. 26, 2002 (JP) ..... 2002-050350
Sep. 3, 2002 (JP) ..... 2002-257622

(51) Int. Cl.
*G04C 11/02* (2006.01)

(52) U.S. Cl. ..... 368/47; 368/11

(58) Field of Classification Search ..... 369/11, 369/47; 455/63.1, 296; 368/55
See application file for complete search history.

(56) References Cited

U.S. PATENT DOCUMENTS 4,321,519 A 3/1982 Ueda et al.
4,321,521 A * 3/1982 Ueda et al. ..... 318/696
4,650,344 A * 3/1987 Allgaier et al. ..... 368/47
5,235,563 A * 8/1993 Ganter et al. ..... 368/47
5,349,570 A * 9/1994 Kaiser ..... 368/47
5,430,693 A * 7/1995 Ganter et al. ..... 368/47
6,269,055 B1 * 7/2001 Pikula et al. ..... 368/47
6,339,306 B1 * 1/2002 Hara ..... 318/696
6,522,601 B1 * 2/2003 Sakuyama ..... 368/47
2003/0174584 A1 * 9/2003 Fujisawa et al. ..... 368/47
2003/0198140 A1 * 10/2003 Shimizu ..... 368/47

FOREIGN PATENT DOCUMENTS

JP 2001-166071 6/2001

* cited by examiner

*Primary Examiner*—Ren Yan
*Assistant Examiner*—Leo T. Hinze
(74) *Attorney, Agent, or Firm*—Michael T. Gabrik

(57) ABSTRACT

An electronic device able to accurately receive external wireless information, a reception controller for the electronic device, and a reception control program for the electronic device. A radio-controlled timepiece has a stepping motor unit and an external wireless information reception unit for receiving a carrier wave with time information. The stepping motor unit has a magnetic field evaluation unit for detecting whether or not an external magnetic field is present and outputting a signal indicative of whether or not such an external magnetic field is present. The external wireless information reception unit has an antenna for receiving external wireless information and a receiving circuit for processing external wireless information received from the antenna. A reception controller controls the external wireless information reception unit according to the external-magnetic-field-detection signal output from the magnetic field evaluation unit.

16 Claims, 21 Drawing Sheets

ELECTRONIC DEVICE, RECEPTION CONTROL METHOD FOR AN ELECTRONIC DEVICE, AND RECEPTION CONTROL PROGRAM FOR AN ELECTRONIC DEVICE

BACKGROUND OF THE INVENTION

1. Field of the Invention

The present invention relates generally to (i) an electronic device that runs a process to receive external wireless data and adjust operation based on the received data, (ii) a reception control method for the electronic device, and (iii) a reception control program for the electronic device. More specifically, the device, which may be a radio-controlled timepiece, is configured to adjust the time by receiving time information from an external source, while the reception control method and program are designed to carry out such the time adjustment operation.

2. Description of the Related Art

Electronic devices that receive wireless data from an external source and adjust operation accordingly, such as radio-controlled timepieces that receive time information from an external source to adjust the time, are known.

Such a radio-controlled timepiece has an antenna for receiving time information from an external transmitter, a receptor for processing information received through the antenna, memory for storing information from the receptor, a stepping motor driven and controlled according to stored time information, and hands that are moved by the stepping motor to indicate the time.

Thus configured, a radio signal carrying precise time information is received through the antenna. This time information is then processed (amplified and demodulated, for example) by the receptor, and a time information series is stored to memory. Stepping motor drive is controlled based on the stored time information, and the precise time is indicated by the rotationally driven hands. Because this operation is performed automatically, radio-controlled timepieces are extremely convenient.

In order for a radio-controlled timepiece to accurately adjust the time, it must accurately receive time information from an external source. A problem, however, is that the time information cannot be accurately received if a magnetic field surrounds the antenna of the radio-controlled timepiece. This is because the magnetic field interferes with the radio signal carrying the time information, and the waveform of the time information signal is distorted.

If the timepiece is stationary like a wall clock, this can be handled by locating it in a place that is not easily subject to magnetic field influences. However, if the timepiece is normally mobile, like a wristwatch, the problem of being unable to avoid the effects of magnetic fields remains.

A radio-controlled timepiece with an internal electromagnetic generator that is not subject to the effects of electromagnetic noise from electromagnetic power generation has been previously proposed. (see, Japanese Patent Laid-Open Publication (kokai) 2001-166071).

This radio-controlled timepiece with internal electromagnetic generator is a radio-controlled timepiece as described above additionally having a generator for generating electricity through electromagnetic generation, a power generation state detector for detecting the generating state of the generator by current detection, and a reception prohibiting unit for prohibiting reception based on the detection signal from the power generation state detector.

With this configuration the generation state detector detects the power generating condition of the generator. If power generation is detected, a detection signal is output from the generation state detector and time information reception is prohibited. Time information is therefore not received while electromagnetic noise produced by the generator producing electricity is present. Time information is received only when the generator is not generating and electromagnetic noise from the generator is not present. The time information can therefore be accurately received at select times, and the radio-controlled timepiece can accurately adjust the time when the time information is received.

The source of magnetic fields around the antenna of the radio-controlled timepiece is not, however, limited to an electromagnetic generator built in to the radio-controlled timepiece. Magnetic fields are also produced by, for example, brightness controls for lights and temperature controls for electric blankets, as well as common household appliances.

One problem is that the radio-controlled timepiece with an internal electromagnetic generator and a corresponding state detector cannot handle magnetic field sources outside the radio-controlled timepiece. More specifically, the generation state detector operates by detecting current from the internal generator, but cannot recognize external magnetic fields. The time information reception operation could therefore be carried out while influenced by an external magnetic field, in which case the time may well be incorrectly adjusted.

This problem is not limited to radio-controlled timepieces, and is common to electronic devices that receive external wireless information to perform some other process.

OBJECTS OF THE INVENTION

An object of the present invention is therefore to solve this problem of the prior art.

It is another object of this invention to provide an improved electronic device that can accurately receive external wireless information, to a reception control method for the electronic device, and to a reception control program for the electronic device.

SUMMARY OF THE INVENTION

An electronic device according to one aspect of the invention comprises an external wireless information reception unit for receiving external wireless information and a stepping motor unit. The external wireless information reception unit includes an antenna for receiving external wireless information, a receiver for processing external wireless information received from the antenna, and a storage medium for storing information received and processed by the receiver. The stepping motor unit includes a stepping motor, a drive controller for controlling stepping motor drive, and an external magnetic field detector for detecting whether or not an external magnetic field is present and outputting a signal indicative of such detection. That is, either outputting an external-magnetic-field-detected signal or an external-magnetic-field-not-detected signal, as the case may be. The stepping motor unit of the invention further includes a reception controller for controlling the external wireless information reception unit according to the signal output by the external magnetic field detector, that is, according to whether an external-magnetic-field-detected signal or an external-magnetic-field-not-detected signal is output.

With this configuration stepping motor drive is controlled by the drive controller and the electronic device performs a specific drive operation. Further, external wireless information transmitted from an external source is received by the antenna. When an external-magnetic-field-not-detected signal is output by the external magnetic field detector, information received by the antenna is processed by the receiver, and the processed information is stored in the storage medium. An internal process of the electronic device is run using the stored information, such as by the drive controller of the external wireless information to control driving of the stepping motor.

When the external-magnetic-field-detected signal is output by the external magnetic field detector, the reception operation of the external wireless information receiving unit is controlled by the reception controller. For example, in such a situation, the reception operation is prohibited or the received information is invalidated. As a result, the effect of an external magnetic field on the reception operation can be reduced.

Because an external magnetic field detector is disposed in the present invention, an external magnetic field around the antenna can be detected. It is therefore possible, for example, to use external wireless information received only while the external-magnetic-field-not-detected signal is output, and control can be applied according to the external magnetic field detection result, such as increasing the number of reception operations when an external magnetic field is detected.

It should be noted that the external wireless information is input to the external magnetic field detector in the presence of an external magnetic field, but because the power of the external magnetic field and external wireless information differ, the external magnetic field and external wireless information can be differentiated in the external magnetic field detector. Because the power of the external magnetic field is high compared with external wireless information signal, and there are both ac magnetic fields and high frequency magnetic fields that interfere with reception of external wireless information by the antenna, it is possible to detect only the external magnetic field instead of the external wireless information by setting the threshold value of the external magnetic field detector greater than or equal to a specified level, for example.

Because the external-magnetic-field-detected signal and external-magnetic-field-not-detected signal are in a front-and-back relationship, a signal separate from the external-magnetic-field-detected signal could be output as the external-magnetic-field-not-detected signal, or a state in which the external-magnetic-field-detected signal is not output could be treated as output of the external-magnetic-field-not-detected signal.

Preferably, the stepping motor comprises a drive coil and the external magnetic field detector comprises an induction voltage detector for detecting an induction voltage induced in the drive coil when an external magnetic field is applied to the drive coil, and wherein the induction voltage detector detects whether or not an external magnetic field is present based on whether or not the induction voltage detector detects an induction voltage induced in the drive coil.

With this configuration, the drive controller drives the stepping motor by sending a drive pulse to the drive coil of the stepping motor. When there is an external magnetic field around the stepping motor, the external magnetic field is applied to the drive coil and an induction voltage is induced therein. An external magnetic field can be detected by detecting the induction voltage induced in the drive coil. The operation of an external magnetic field detector can therefore be achieved by providing an induction voltage detector for detecting this drive coil induction voltage. That is, the drive coil of the stepping motor functions also functions as an external magnetic field antenna. By constructing the external magnetic field detector using the drive coil of the stepping motor that is being controlled, a detector for external magnetic field detection does not need to be separately provided. Thus, the size of the electronic device can be reduced.

Preferably, the drive controller of the electronic device controls the driving of the stepping motor according to whether the external-magnetic-field-detected signal or the external-magnetic-field-not-detected signal is output.

With this configuration, output of the drive pulse for driving the stepping motor can be adjusted, for example, by the drive controller according to whether or not an external magnetic field is detected by the external magnetic field detector. Because, if an external magnetic field is present, the external magnetic field will affect the drive coil of the stepping motor. Thus, the stepping motor may not be driven normally. However, because stepping motor drive is controlled according to detection of an external magnetic field by the external magnetic field detector, the stepping motor can be dependably driven even when exposed to an external magnetic field.

Both stepping motor drive and receiver operation are controlled by the output signal from the external magnetic field detector. A common external magnetic field detector can therefore be used for stepping motor drive control and reception control of the receiver. As a result, control is simplified because the respective controls can be unified. Furthermore, power consumption can be reduced and the space requirements of the electronic circuit can be reduced compared with separately providing external magnetic field detectors for stepping motor drive control and reception control of the receiver.

Preferably, the stepping motor comprises a rotor and the drive controller comprises a special drive pulse output unit for outputting a special drive pulse with a higher effective value than a normal drive pulse, the special drive pulse being output to rotate the rotor when the external-magnetic-field-detected signal is output by the external magnetic field detector.

Because the presence of an external magnetic field disrupts the induction field induced in the stepping motor, it is possible that the normal pulse will not rotate the rotor. With the present invention, however, the presence of an external magnetic field is detected by the external magnetic field detector, and the rotor is dependably rotated by a special drive pulse with a high effective value even when there is the possibility that the external magnetic field will interfere with rotor rotation. The rotor of the stepping motor can therefore be dependably rotated even when an external magnetic field is present.

Preferably, the reception controller comprises a reception operation prohibiting unit for prohibiting the reception operation by the receiver in the case of receiving the external-magnetic-field-detected signal from the external magnetic field detector, and a reception operation resuming unit for resuming reception operation by the receiver in the case of receiving the external-magnetic-field-not-detected signal from the external magnetic field detector.

In this configuration, when the external-magnetic-field-detected signal is output reception operation of the receiver is prohibited by the reception operation prohibiting unit. That is, when an external magnetic field surrounds the antenna and the external wireless information cannot be correctly received, the receiver does not receive. Because the reception operation does not work when the antenna is in the presence of an external magnetic field, receiving wrong information under the influence of an external magnetic field is eliminated. Such selective operation of the receiver also reduces wasteful power consumption.

When the external-magnetic-field-not-detected signal is output, the reception operation prohibited by the reception operation prohibiting unit is resumed by the reception operation resuming unit. Because the external wireless information is received only when an external magnetic field does not surround the antenna, the external wireless information can be correctly received.

Preferably, the reception controller comprises a received information invalidation unit for invalidating a specific unit of data including external wireless information received, when the external-magnetic-field-detected signal is received, and a received information validation unit for validating data other than the specific unit of data, when the external-magnetic-field-detected signal is received.

With this configuration, a specific unit of data in the received information from the receiver including external wireless information determined to have been affected by an external magnetic field due to the external-magnetic-field-detected signal having been output is invalidated by the received information invalidation unit. That is, of information received by the receiver while an external magnetic field surrounds the antenna, the external wireless information which cannot be correctly processed is invalidated and not used. Here invalidated means that the received information from the receiver is not stored in the storage medium, or information stored in the storage medium is deleted.

The specific unit of data including external wireless information received when the external-magnetic-field-detected signal is received could be the bit data of the external wireless information received at the point the external-magnetic-field-detected signal is output. Or it could include an amount of bit data before and after said bit data. Or it could be one frame of external wireless information. For example, if it is a long wave standard radio signal including in one frame unit data such as the hour, minute, and year composed of one bit signals, the single bit of data received when an external magnetic field is detected could be invalidated, or a number of bits before and after this data bit could be invalidated, or the hour, minute, or year unit data could be invalidated, or the one frame could be invalidated.

External wireless information in the received information received by the receiver when the external-magnetic-field-not-detected signal is output and is not affected by an external magnetic field is validated by the received information validation unit. That is, only external wireless information that is correctly received when an external magnetic field does not surround the antenna is used. Here validation means the received information from the receiver is stored in the storage medium, and, for example, the drive controller controls stepping motor drive according to this stored information.

This can be handled in the present invention using a software process such as not storing in, or deleting from, the storage medium external wireless information received when an external magnetic field is present. Therefore, compared with control by means of turning the receiver on and off, receiving and processing external wireless information can start immediately when the external-magnetic-field-not-detected signal is received without requiring delay time for the receiver to start up. Thus, information can be immediately processed.

Preferably, the reception controller executes a reception operation on the receiver a specific number of times when the external-magnetic-field-not-detected signal is received during the reception operation of the receiver, adds an indication that the external wireless information was influenced by an external magnetic field and executes the reception operation on the receiver a number of times greater than the specific number of times when the external-magnetic-field-detected signal is received during the reception operation of the receiver.

With this configuration, reception ends after a specific number of times while receiving time information and the external-magnetic-field-not-detected signal is output, and the electronic device is operated based on external wireless information obtained by this specific number of reception operations. Because the likelihood is high that reception is accurate when there is no external magnetic field present during the reception operation, the reception operation can be run a specific number of times, such as twice.

On the other hand, when there is an external magnetic field and the external-magnetic-field-detected signal is output, indication that reception was influenced by an external magnetic field is added to the external wireless information and the number of receptions is increased. That is, when there is an external magnetic field the number of reception operations is increased, for example to three, to obtain accurate external wireless information with the recognition that reception is influenced by the external magnetic field. The received external wireless information, including the external wireless information affected by an external magnetic field, is then handled. For example, subsequent handling of the received external wireless information is determined by comparing the received external wireless information. Therefore, compared with invalidating or prohibiting reception from the start, the probability of accurately receiving external wireless information can be increased even in an external magnetic field, and the efficiency of the reception operation can be increased.

It should be noted that "adds an indication to the external wireless information that it was influenced by an external magnetic field" means adding to the received data a mark indicating that the data was affected by an external magnetic field by, for example, setting a flag denoting 0, 1, or on/off.

Preferably, the reception controller terminates the reception operation of the receiver based on a set schedule information, and disables the reception operation termination process based on the schedule information and repeatedly executes the reception operation of the receiver multiple times when the external-magnetic-field-detected signal is received during this reception operation.

With this configuration, the reception operation is started by the receiver when the reception operation start time is reached based on the set schedule information. Then when the reception operation end time based on the set schedule information is reached reception by the receiver ends. For example, if the reception operation is scheduled for three minutes starting from 2:00 a.m. everyday, the reception operation starts at 2:00 a.m. and the reception operation ends at 2:03 a.m.

If the external-magnetic-field-detected signal is output before the reception operation of the receiver starts or while the reception operation of the receiver is running, an external magnetic field is recognized and the process for ending the reception operation is disabled. While the reception operation ending process is disabled the reception operation repeats multiple times. The reception operation ends after the reception operation runs multiple times. For example, when receiving a long wave standard radio signal containing time information the signal takes 60 seconds (1 minute) to transmit one data block, and a reception operation for one data block runs at one minute intervals. Therefore, when the schedule is set to receive for three minutes from 2:00 a.m. (three reception operations) and an external-magnetic-field-detected signal is output, the reception ending setting at 2:03 a.m. is invalidated and the schedule is set to repeat the reception operation ten times (for ten minutes), for example. Disabling the reception operation ending process therefore means to not end the reception operation even when the end time of the set schedule is reached.

Power consumption can be reduced because external wireless information is received at a specific time interval according to a set schedule. Furthermore, because the reception operation repeats if an external magnetic field is detected at the set start time of the reception operation, the possibility of being able to receive accurately can be increased even when an external magnetic field is present. If only accurately received information is used from the information obtained in plural reception operations, the electronic device can be accurately operated according to the external wireless information even when in an external magnetic field.

Because the number of receptions can be increased automatically when in an external magnetic field according to the present invention, the normal reception operation executed according to the schedule when there is no external magnetic field can be run a minimum number of times, and power consumption can be minimized. Further, by increasing the number of reception operations when an external magnetic field is present, the possibility of accurately receiving information increases, and information can be received even when there is an external magnetic field. Therefore, unlike not running the reception operation when there is an external magnetic field, external wireless information can be received even when there is an external magnetic field, and external wireless information can be received quickly and regularly.

It should be noted that the number of times the reception operation repeats can be preset, or verifying whether the received data is accurate can be provided and operation set to repeat until correct data is received. Because the likelihood that correct data can be received even in an external magnetic field can be improved by increasing the number of receptions, correct data can normally be received by repeating reception a preset number of times, such as 10 times or 20 times. However, verifying the received data has the advantage of being able to reliably receive correct data.

Preferably, the reception operation resuming unit resumes the reception operation of the receiver a specific time after an external-magnetic-field-not-detected signal is received from the external magnetic field detector.

Preferably, the received information validation unit validates received information from the receiver a specific time after an external-magnetic-field-not-detected signal is received from the external magnetic field detector.

Because the reception operation resumes or received information is validated after a specific time after the external-magnetic-field-not-detected signal is output, the reception operation can be resumed or the received information validated after the external magnetic field is reliably gone.

This specific time can be set appropriately considering how the electronic device is used.

When the electronic device is a portable device such as a watch, surrounding conditions will likely change from moment to moment as the device is moved. In this situation, the device's surrounding external magnetic field may also change from moment to moment. Thus, it is possible that the magnetic field around the electronic device will occur intermittently, that is, the external magnetic field disappears momentarily but appears again soon. If the reception operation starts immediately after the external-magnetic-field-not-detected signal is output in such cases the external wireless information could be falsely received while in an external magnetic field.

However, because the present invention resumes the reception operation or validates the received information after waiting a specific time from external-magnetic-field-not-detected signal output and detecting for a specific time that there is no external magnetic field, external wireless information received accurately under conditions free of an external magnetic field can be used.

The external wireless information preferably comprises a signal transmitted at a constant period, and the external magnetic field detector detects whether or not an external magnetic field is present at a desired period according to the period of the external wireless information signal.

If the external wireless information is composed of signals transmitted at a constant cycle, for example, 1 Hz, such as a composition of, for example, signals of 1 bit per second transmitted consecutively, the external magnetic field detector runs external magnetic field detection at a desired cycle, such as 1 Hz, according to the external wireless information signal cycle. When receiving external wireless information it is therefore possible to detect whether there is an external magnetic field during reception at a desired period unit of the signal being received. Because an external magnetic field can be detected at a desired signal period it is also possible to determine whether reception is affected by an external magnetic field at a desired signal period unit. Whether the external wireless information is valid or invalid can therefore be determined at the desired signal period unit, for example. As a result, handling the received information can be controlled at each signal period, and the received information can be handled precisely and efficiently.

Preferably, the electronic device is a timepiece device having hands driven by the stepping motor.

Preferably, the external wireless information contains time information, and the stepping motor drives and adjusts the hands based on the time information.

If a sequence of time information, for example, is carried by the external wireless information it can be received by the antenna with this configuration. The external wireless information can thus be received according to detection of an external magnetic field, and the hands can be driven by the stepping motor according to the received information to display the time.

When accurate time information, for example, is carried by a radio frequency signal as the external wireless information, the time is indicated according to this time information and the time displayed by this timepiece device will be accurate. Moreover, because the user does not need to spend time adjusting the time if the time is automatically adjusted according to this time information, a maintenance-free timepiece device can be provided.

Preferably, the receiver receives the external wireless information in a state in which the drive pulse of the drive controller is stopped and an external magnetic field is being detected by the external magnetic field detector.

With this configuration, the drive pulse from the drive controller is stopped when receiving external wireless information. Because the drive pulse is stopped an induction field does not occur in the motor coil of the stepping motor and hence does not affect the external wireless information. The external wireless information can therefore be received accurately by the external wireless information reception unit.

If the electronic device is, for example, a timepiece device that can adjust time based on the external wireless information, the time can be adjusted after receiving the external wireless information is completed even if stepping motor drive is stopped while receiving the external wireless information. Stopping rotor drive for the short time in which the external wireless information is received does not particularly inconvenience the user, and the external wireless information can be accurately received by stopping the rotor drive pulse.

The above electronic device is preferably a portable electronic device that can be carried about.

If an electronic device is located in a fixed position where it is not easily subject to external magnetic fields, the effects of an external magnetic field can be largely avoided. However, in the case of a portable electronic device the surrounding conditions can change moment to moment as the portable device is transported, thereby increasing the likelihood that the device will become susceptible to an external magnetic field. The presence of an external magnetic field poses a problem for a device that is adapted to receive external wireless information but is unable to detect the presence of such a field. External information is distorted and cannot be received correctly in the presence of such a field. The present invention solves that problem by employing an external magnetic field detector, so that accurate external wireless information can be received when no external magnetic field is present.

A reception control method for an electronic device is also provided in accordance with another aspect of the invention. The electronic device comprises a stepping motor unit having a stepping motor and an external wireless information reception unit having an antenna for receiving external wireless information. The method comprises detecting whether or not an external magnetic field is present and outputting a signal indicative of whether or not an external magnetic field is detected; processing external wireless information received from the antenna; storing received and processed external wireless information; and controlling at least one of the processing and storing step according to whether the signal outputted indicates that an external magnetic field is present or not.

With this configuration, when external wireless information is transmitted from an external source, it is received by the antenna. When an external-magnetic-field-not-detected signal is output in the external magnetic field detection step, the information received by the antenna is processed in the received information processing step, and the processed information is stored in the storage step. When the external-magnetic-field-detected signal is output in the external magnetic field detection step, the received information processing step is controlled by the reception control step, for example, received information processing is prohibited or the received information is invalidated.

Because an external magnetic field detection step is provided in this aspect of the present invention, an external magnetic field around the antenna can be detected. It is therefore possible to use external wireless information received only while the external-magnetic-field-not-detected signal is output. As a result external wireless information can be accurately received without being affected by external magnetic fields, and the electronic device can be driven according to this correctly received external wireless information.

The method may include additional steps/functions as described above in connection with the electronic device.

In accordance with still another aspect of the invention, a reception control program for an electronic device is provided. Such a program is adapted to be executed on a computer integrated with the electronic device that comprises a stepping motor unit having a stepping motor and an external wireless information reception unit having an antenna for receiving external wireless information. The reception control method comprises detecting whether or not an external magnetic field is present and outputting a signal indicative of whether or not an external magnetic field is detected; processing external wireless information received from the antenna; storing received and processed external wireless information; and controlling the external wireless information reception unit according to whether the signal outputted indicates that an external magnetic field is present or not.

Thus configured the same operational effects as described above can be achieved. That is, detecting an external magnetic field makes it possible to use only correctly received external wireless information. For example, the electronic device can be accurately driven according to this external wireless information.

Because a computer is operated by this program in the present invention, settings can be changed easily. That is, because it can be installed to an electronic device by CD-ROM or other recording medium or the Internet or other communications device if provided as a program, the external magnetic field detection level settings can be easily optimally set according to the characteristics of the particular electronic device, and more precise reception control can be achieved.

Other objects and attainments together with a fuller understanding of the invention will become apparent and appreciated by referring to the following description and claims taken in conjunction with the accompanying drawings.

DESCRIPTION OF THE PREFERRED EMBODIMENTS

Embodiments of the present invention are described below in conjunction with examples thereof shown in the accompanying figures.

Embodiment 1

Figure 1:
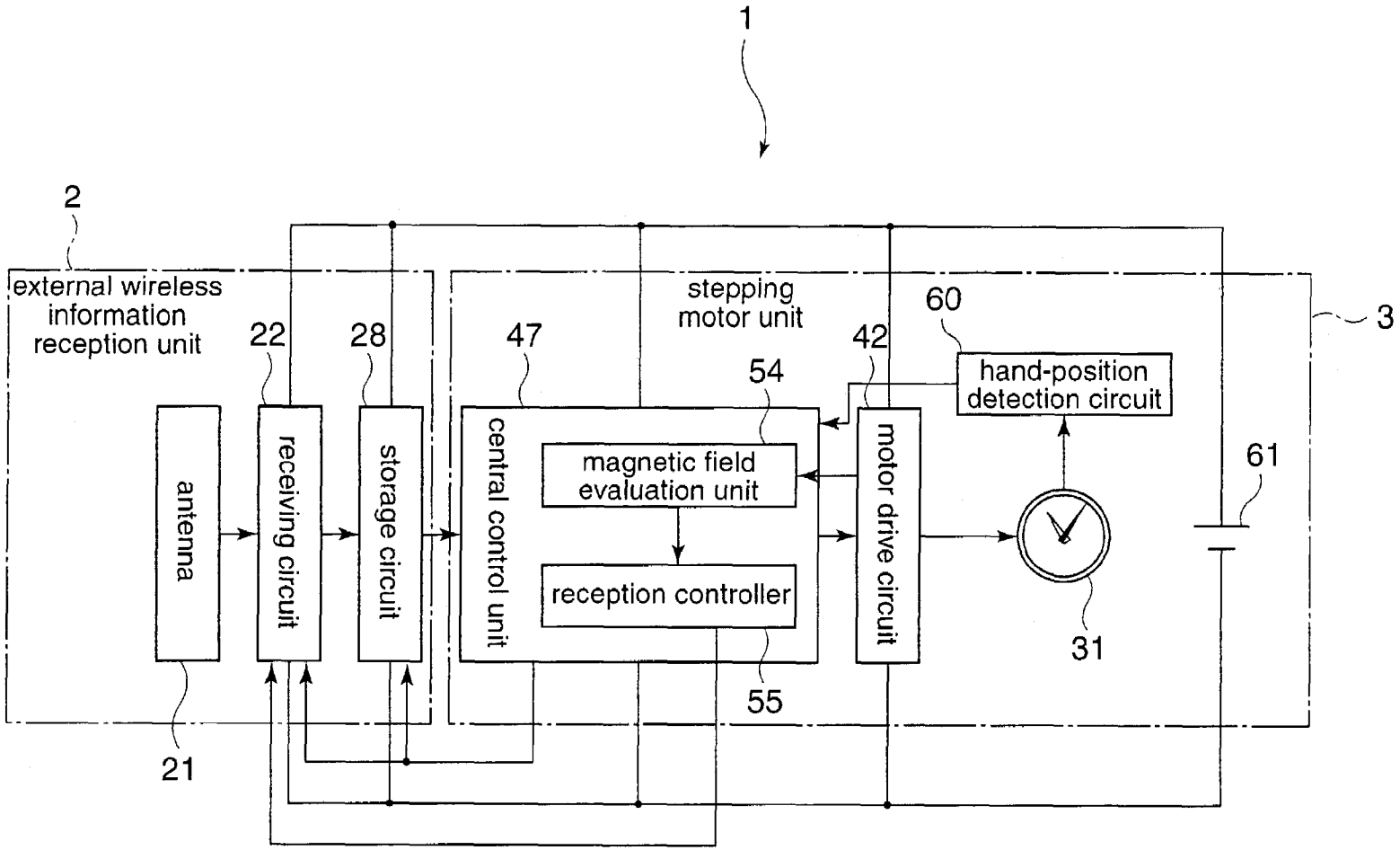
FIG. 1 is a block diagram of a first embodiment of an electronic device according to the present invention.

FIG. 1 is a block diagram of a portable, radio-controlled timepiece 1 (e.g., a wristwatch) in accordance with a first embodiment of an electronic device according to the present invention.

This radio-controlled timepiece 1 has an external wireless information reception unit 2 and a stepping motor unit 3.

The external wireless information reception unit 2 has a ferrite antenna 21 for receiving a long wave standard radio signal to which time information is superposed as the external wireless information, a receiving circuit 22 as a receiver for processing and outputting the long wave radio signal received by the antenna 21 as time information, and a storage circuit 28 as memory (storage medium) for storing the time information output from the receiving circuit 22.

The stepping motor unit 3 has a movement 31 for driving the hands indicating the time by means of a stepping motor 32 (see FIG. 5), a motor drive circuit 42 for driving the stepping motor 32, a central control unit 47 as a drive controller for overall control of the radio-controlled timepiece 1, a hand-position detection circuit 60 for detecting hand positions, and a battery 61 as a power source.

The antenna 21 receives a long wave radio signal to which time information is superposed.

Figure 2:
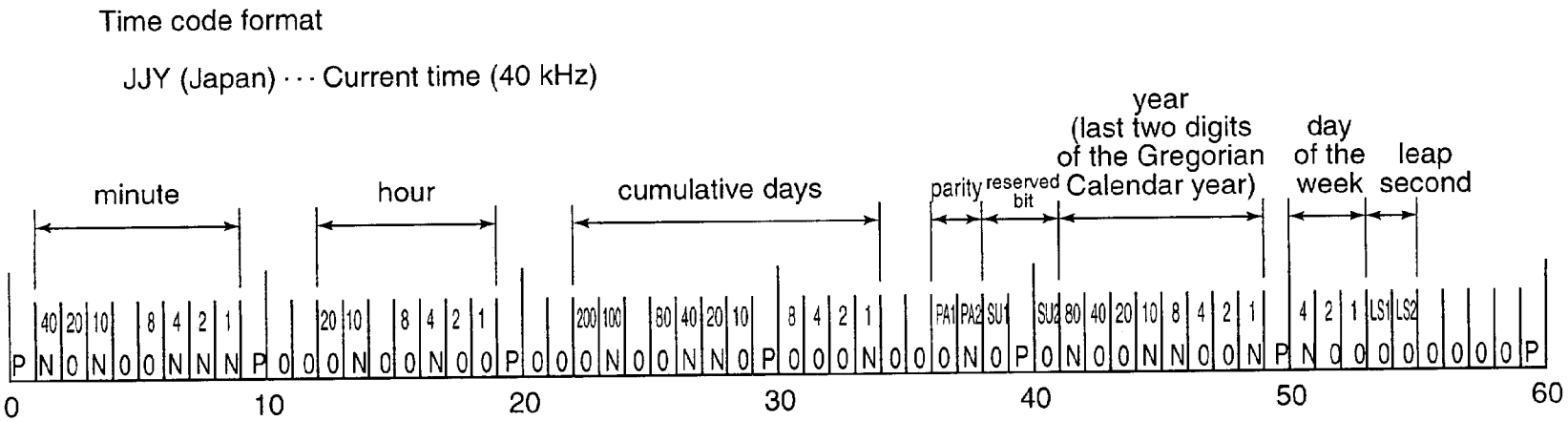
FIG. 2 shows a time code format of time information as a long wave standard radio signal.

FIG. 2 shows the time code format of the long wave radio signal superposed with time information. This time code format signal is transmitted once a second and every 60 seconds constitute one frame.

As shown in FIG. 2, the time code format of this standard long wave radio signal contains binary-coded decimal values for the following items: the minute and the hour of the current time, the cumulative days since January 1 of the current year, the year (last two digits of the Gregorian calendar year), day of the week, and leap second. The value of each item contains a combination of binary values (bits) assigned every second, and the on/off states of these combinations are determined from the signal type.

Figure 3:
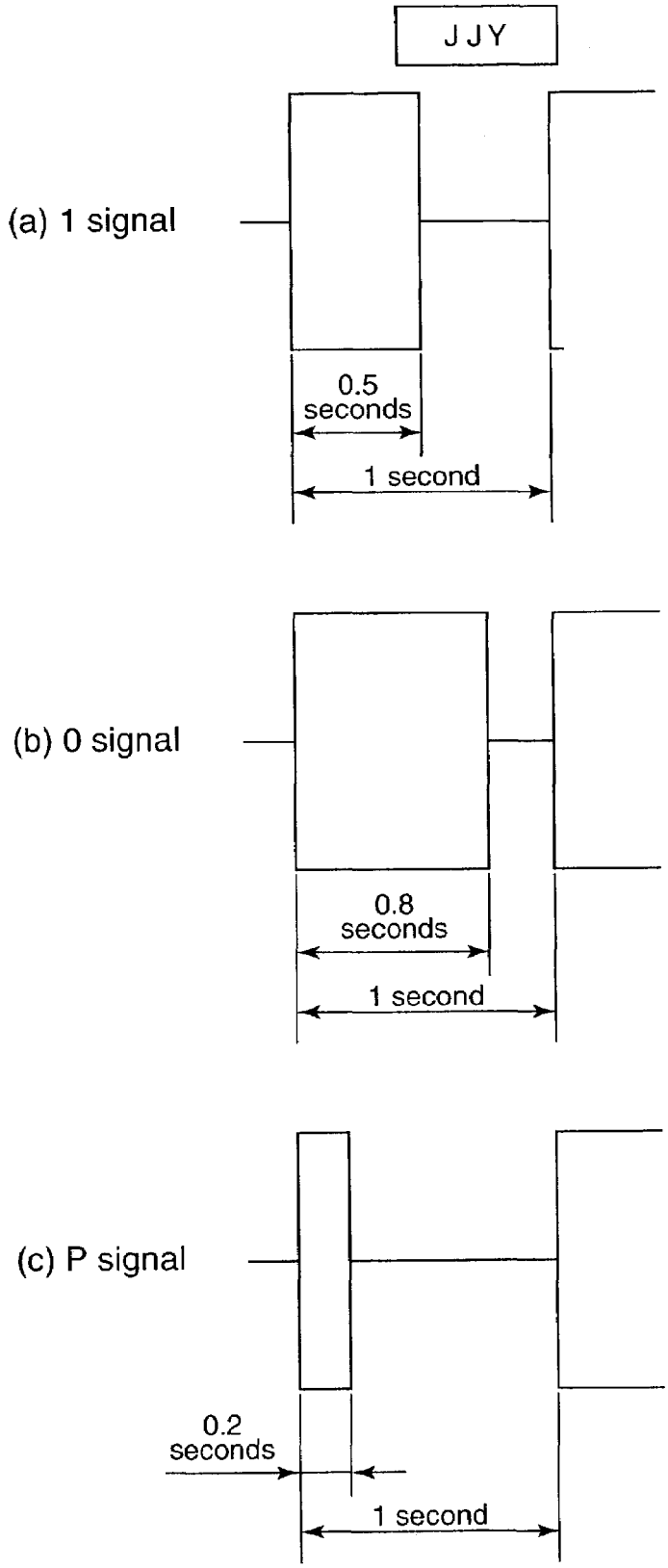
FIG. 3 shows types of time code format signals.

As shown in FIG. 3, the standard long wave radio signal contains three types of signals denoting binary 1, binary 0, and position marker P. The type of signal is determined from the amplitude modulation time of the signal. FIG. 3(*a*) shows the waveform of a binary-1 signal, which is identified by the amplitude holding for 0.5 seconds from the rising edge of the signal. FIG. 3(*b*) shows the waveform of a binary-0 signal, which is identified by the amplitude holding for 0.8 seconds from the rising edge of the signal. FIG. 3(*c*) shows the waveform of a position marker "P" signal, which is identified by the amplitude holding for 0.2 seconds from the rising edge of the signal.

A binary-1 signal denotes an ON state, and the corresponding values for each "1" bit are added to calculate the hour, minute, or other field value. Note that in FIG. 2 an "N" in the time code format of the long wave radio signal denotes transmission of a binary-1 signal.

If a signal other than a binary-1 is transmitted, the bit is OFF and indicates that the corresponding value is not to be used when computing the hour, minute, or other field value.

For example, if the long wave radio signals transmitted in the eight seconds corresponding to the minute denote 10100111, the minute of the current time is known to be 40+10+4+2+1=57. Bits containing the position marker P in the long wave radio signal are fixed and used to synchronize the long wave radio signal and time code format. The first position marker P in the time code is a frame reference marker corresponding to the rising edge of full minute (second 0 of each minute), and thus denotes the second is 00 and the minute has changed to the next minute.

It should be noted that this long wave radio signal is based on a cesium atomic clock, and radio-controlled timepieces that receive and adjust the time based on this long wave radio signal can achieve extremely high precision with error of less than one second in one million years.

Figure 4:
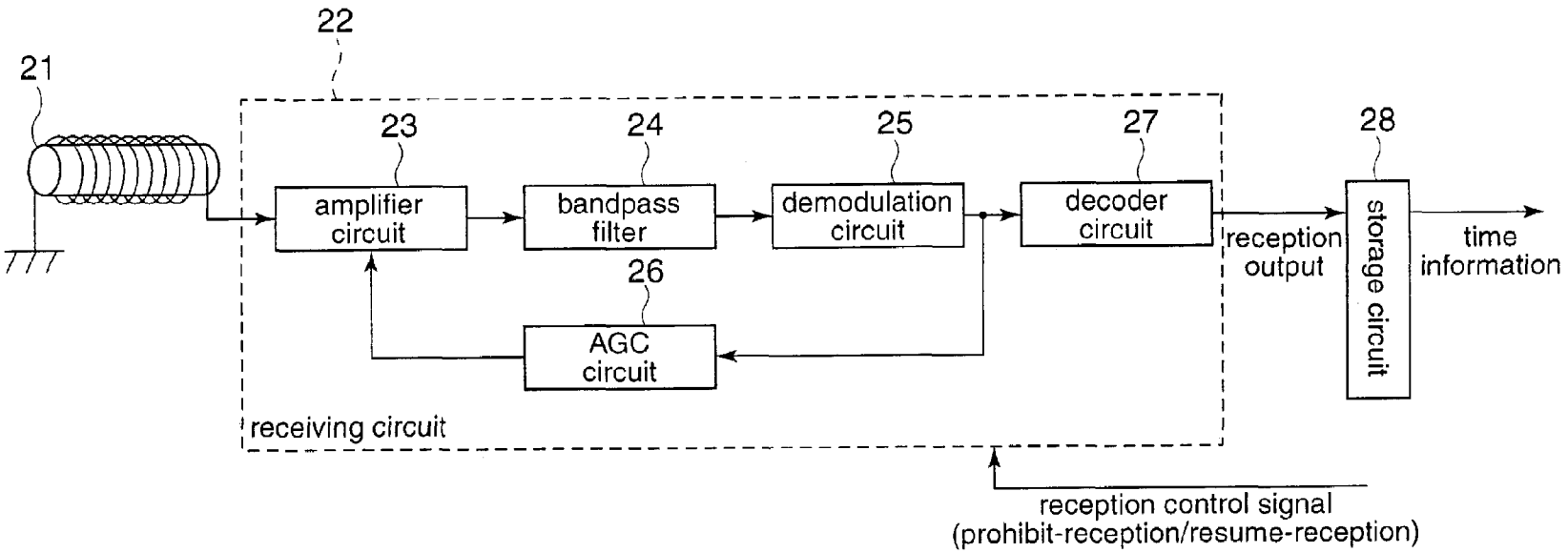
FIG. 4 shows a receiving circuit for the first embodiment of the invention.

As shown in FIG. 4, the receiving circuit 22 has an amplifier circuit 23, bandpass filter 24, demodulation circuit 25, AGC circuit 26, and decoder circuit 27. The amplifier circuit 23 amplifies the long wave radio signal received by antenna 21. The bandpass filter 24 extracts a desired frequency component from the amplified long wave radio signal, and the demodulation circuit 25 then smoothes and demodulates the long wave radio signal. The AGC (automatic gain control) circuit 26 controls the gain of the amplifier circuit 23 so that the reception level of the long wave radio signal is constant. The decoder circuit 27 then decodes and outputs the demodulated long wave radio signal. The receiving circuit 22 thus processes the received information.

The reception control signal input to the receiving circuit 22 is supplied from central control unit 47 to control the operating mode of the receiving circuit 22. This is more fully described below.

Figure 5:
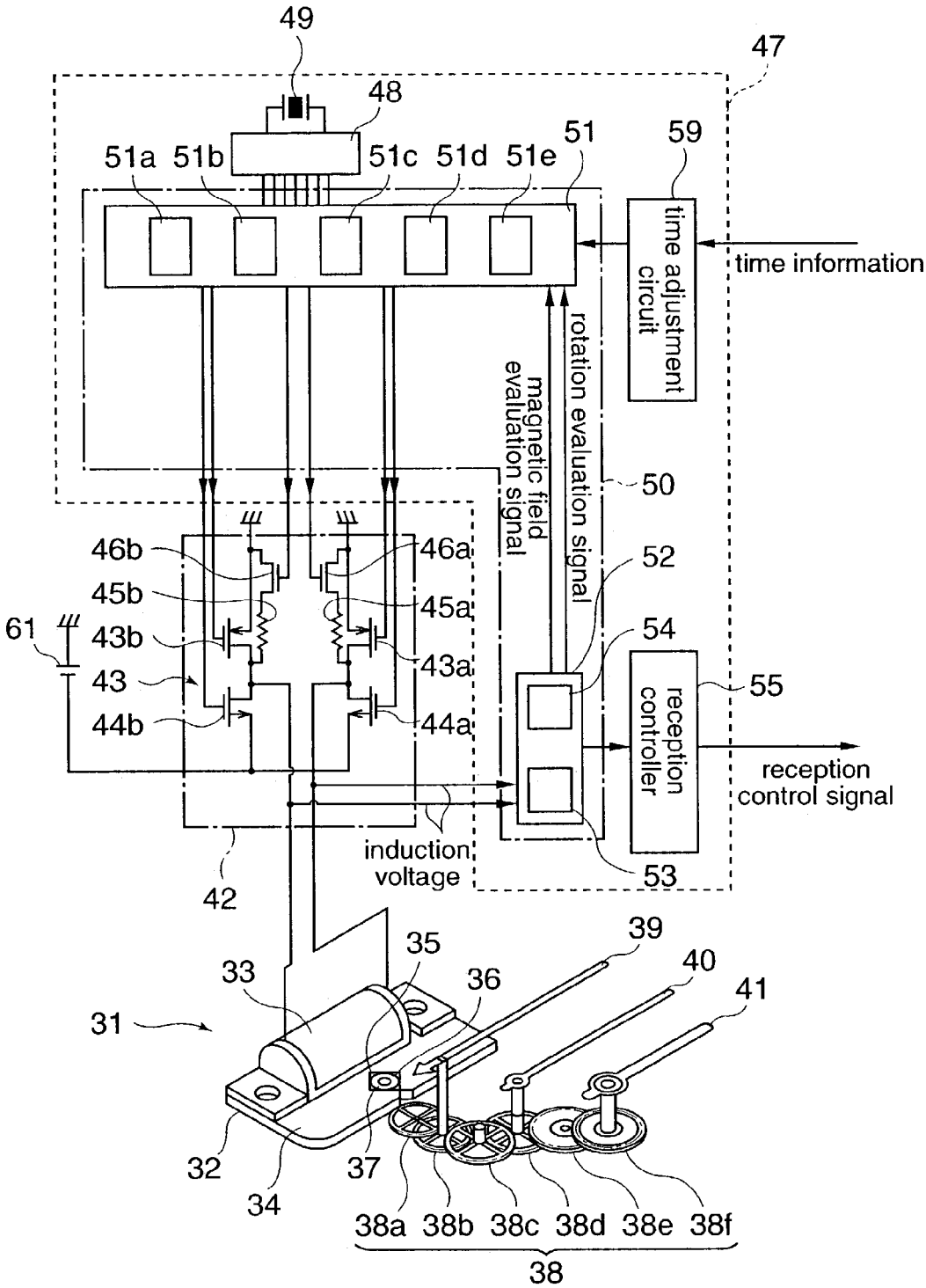
FIG. 5 shows the movement, central control unit, and motor drive circuit for the first embodiment.

FIG. 5 shows the movement 31, central control unit 47, and motor drive circuit 42. The movement 31 includes the stepping motor 32, a gear train 38 for transferring motion from stepping motor 32, and a second hand 39, minute hand 40, and hour hand 41 advanced by the gear train 38.

The stepping motor 32 has a drive coil 33 for generating magnetic force from a drive pulse supplied from the motor drive circuit 42, stator 34 excited by the drive coil 33, and a rotor 37 rotated by the magnetic field excited in the stator 34. The rotor 37 is a disk-shaped two-pole permanent magnet.

The stator 34 has a magnetic saturation part 35 for producing magnetic poles that differ according to the magnetic force produced by the drive coil 33 at different phases (poles) around the rotor 37. An internal notch 36 is disposed at an appropriate position to the inside circumference of the stator 34 in order to regulate the direction of rotor 37 rotation, producing cogging torque to stop the rotor 37 at an appropriate position.

Rotation of the rotor 37 of stepping motor 32 is transferred to the hands by a gear train 38 consisting of fifth wheel 38*a* meshed with the rotor 37 through a pinion, fourth wheel 38*b*, third wheel 38*c*, second wheel 38*d*, day wheel 38*e*, and center wheel 38*f*. The second hand 39 is connected to the shaft of the fourth wheel 38*b*, the minute hand 40 is connected to the second wheel 38*d*, and the hour hand 41 is connected to center wheel 38*f* so that the time is indicated by the hands in conjunction with rotation of the rotor 37. It will be obvious that a transmission system for displaying the date, for example, could also be connected to the gear train 38.

The central control unit 47 consists of a pulse synthesizing circuit 48, control circuit 50, reception controller 55, and time adjustment circuit 59. The pulse synthesizing circuit 48 has an oscillator or frequency-divider using a quartz oscillator or other reference oscillation source 49 to produce a high frequency oscillation, and generates pulse signals with different timing and pulse width or the reference frequency pulse of the reference frequency. The control circuit 50 controls the stepping motor 32 based on the various pulse signals supplied from pulse synthesizing circuit 48. The reception controller 55 controls the operating mode of the receiving circuit 22 based on signals from the control circuit 50. The time adjustment circuit 59 adjusts the time based on time information from the receiving circuit 22.

The control circuit 50 consists of a drive control circuit 51 for controlling the motor drive circuit 42, and a detection circuit 52 for rotation detection and magnetic field detection.

The drive control circuit 51 has a drive pulse supply part 51*a*, rotation detection pulse supply part 51*b*, magnetic field detection pulse supply part 51*c*, complementary pulse supply part 51*d*, and demagnetizing pulse supply part 51*e*. The drive pulse supply part 51*a* supplies a drive pulse for driving the rotor 37 to drive coil 33 via the motor drive circuit 42. The rotation detection pulse supply part 51*b* outputs a rotation detection pulse inducing an induction voltage for detecting rotation of the rotor 37 after the drive pulse is applied. Before the drive pulse is applied the magnetic field detection pulse supply part 51*c* outputs a magnetic field detection pulse inducing an induction voltage for detecting a magnetic field external to the stepping motor 32. If the rotor 37 is not rotating or an external magnetic field is detected, the complementary pulse supply part 51*d* outputs a complementary pulse with more effective power than the drive pulse. A special drive pulse generator is formed by this complementary pulse supply part 51*d*.

Following this complementary pulse, the demagnetizing pulse supply part 51*e* outputs a demagnetizing pulse of a different polarity than the complementary pulse.

The detection circuit 52 has a rotation evaluation unit 53 and magnetic field evaluation unit 54. The rotation evaluation unit 53 detects rotation by comparing the induction voltage for rotation detection obtained with the rotation detection pulse with a set value. The magnetic field evaluation unit 54 detects a magnetic field by comparing the induction voltage for magnetic field detection obtained with the magnetic field detection pulse.

Figure 6:
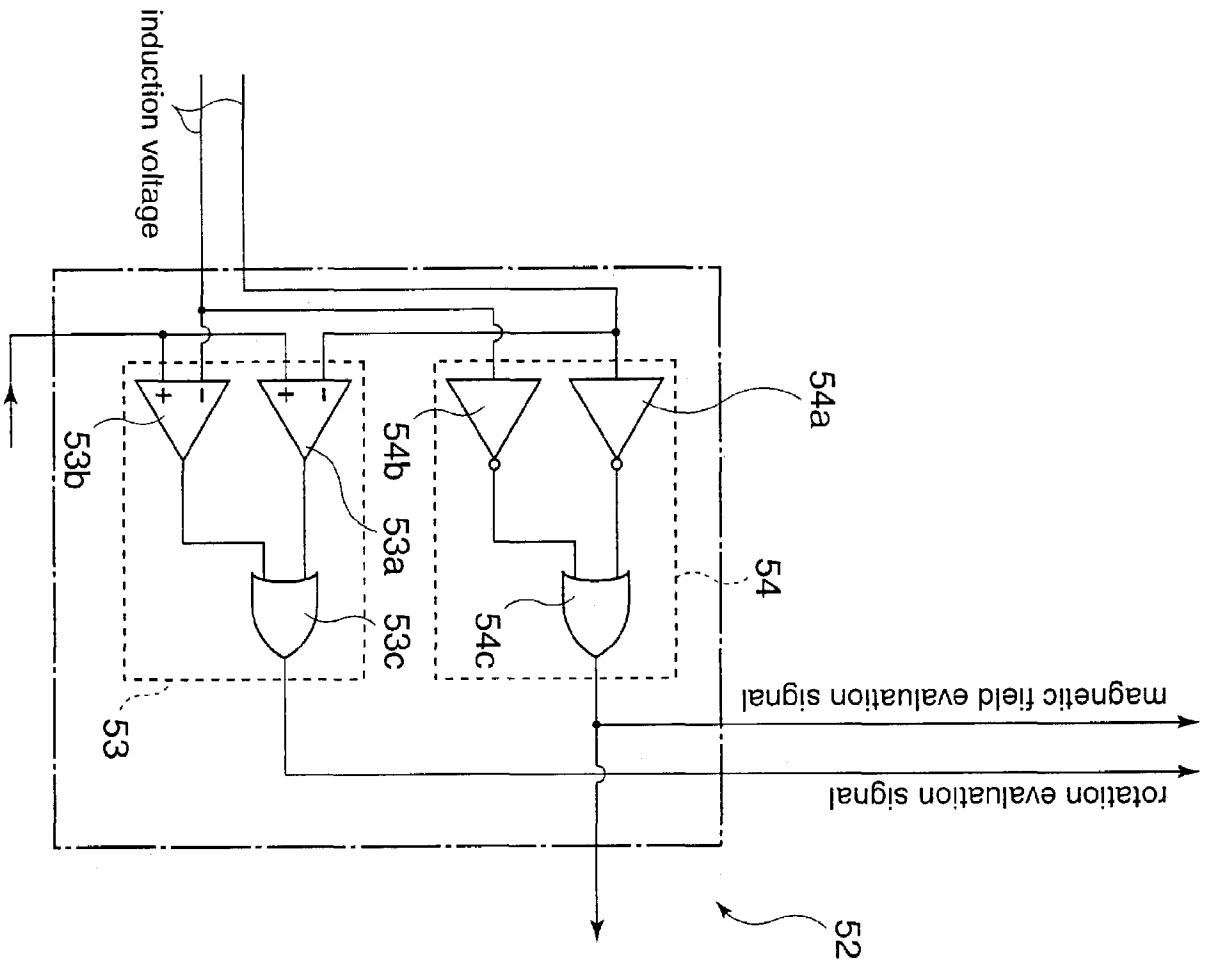
FIG. 6 shows the detection circuit for the first embodiment.

As shown in FIG. 6, the rotation evaluation unit 53 has two comparators 53*a*, 53*b*, and an OR gate 53*c*. It compares the value of the bi-directional induction voltage produced in drive coil 33 with setting SV1 to confirm whether or not the rotor 37 rotated. The result if fed back as a rotation evaluation signal to the drive control circuit 51 through the OR gate 53*c*.

The magnetic field evaluation unit 54 has two inverters 54*a*, 54*b* and an OR gate 54*c*. It evaluates the presence of a magnetic field by comparing the values of the bi-directional induction voltages produced in the drive coil 33 by an external magnetic field with the inverter threshold value (setting SV2). The result is fed back to the drive control circuit 51 as a magnetic field evaluation signal through OR gate 54*c*, and output to the reception controller 55. That is, an external-magnetic-field-detected signal is output to the reception controller 55 when an external magnetic field is detected. If an external magnetic field is not detected, an external-magnetic-field-not-detected signal is output to the reception controller 55.

An induction voltage detector is formed by this magnetic field evaluation unit 54, and an external magnetic field detector is formed by and an external magnetic field detection process is run by the control circuit 50 and magnetic field evaluation unit 54, the drive coil 33 of stepping motor 32, and the motor drive circuit 42.

The motor drive circuit 42 is composed of a bridge circuit 43, rotation detection resistors 45*a*, 45*b*, and sampling p-channel MOS 46*a* and 46*b* for supplying a chopper pulse to resistors 45*a*, 45*b*. The bridge circuit 43 has p-channel MOS 43*a* and n-channel MOS 44*a*, and p-channel MOS 43*b* and n-channel MOS 44*b*, connected in series. The rotation detection resistors 45*a*, 45*b* are parallel connected to p-channel MOS 43*a* and 43*b*, respectively. These control the power supplied to the stepping motor 32 from the battery 61.

Drive pulses of different polarity are supplied to the drive coil 33 or detection pulses exciting an induction voltage for detection rotation of the rotor 37 or magnetic field detection are supplied by applying control pulses of different polarity and pulse width from the pulse supply parts 51*a* to 51*e* or the drive control circuit 51 at respective timing to the gate electrodes of MOS devices 43*a*, 43*b*, 44*a*, 44*b*, 46*a*, and 46*b*.

Figure 7:
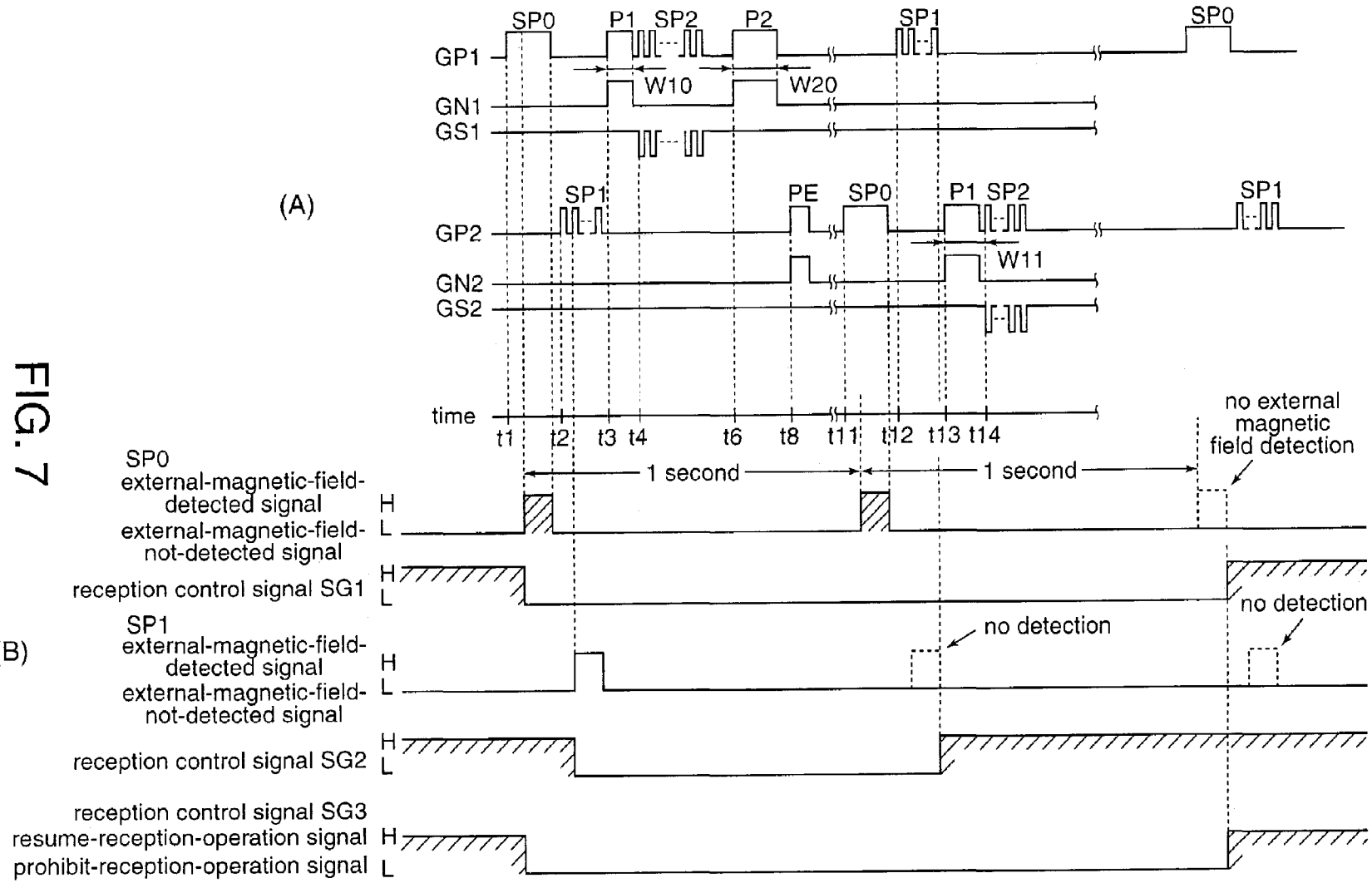
FIG. 7(A) shows a timing chart of the control signal output from the drive control circuit.
FIG. 7(B) shows a timing chart of the reception control signal according to external magnetic field detection.

FIG. 7(A) is a sample timing chart of the control signal supplied from the drive control circuit 51 to the motor drive circuit 42. Note that GP1 here denotes the gate of p-channel MOS 43*a*, GN1 denotes the gate of n-channel MOS 44*a*, GS1 denotes the gate of p-channel MOS 46*a*, GP2 denotes the gate of p-channel MOS 43*b*, GN2 denotes the gate of n-channel MOS 44*b*, and GS2 denotes the gate of p-channel MOS 46*b*.

The signals supplied to GP1, GN1, and GS1 excite one pole of the drive coil 33 of stepping motor 32. The signals supplied to GP2, GN2, and GS2 excite the opposite pole.

The stepping motor 32 advances the hands every second, and a continuous control signal is supplied to the motor drive circuit 42.

Magnetic field detection pulses SP0 and SP1 are output at the start of each cycle. Magnetic field detection pulse SP0 is output at time t1. This magnetic field detection pulse SP0 is a control pulse sequence with a pulse width of approximately 20 ms for detecting magnetic field noise caused by high frequency noise (50 Hz to 60 Hz) resulting from switching such household electrical appliances as electric blankets and electric foot warmers.

The control signal for outputting magnetic field detection pulse SP0 is supplied from magnetic field detection pulse supply part 51*c* to the drive-side (drive pole side) gate GP1 so that only one pole is on and the drive coil 33 functions as an external magnetic field antenna. When an induction voltage is induced in the drive coil 33 by an external magnetic field, this enables the level of the induction voltage to be compared with the threshold values of the inverters 54*a*, 54*b* of the magnetic field evaluation unit 54. An external magnetic field can thus be detected.

Magnetic field detection pulse SP1 is output at time t2. This magnetic field detection pulse SP1 is an intermittent chopper pulse with a duty ratio of approximately ⅛, and is for detecting such ac fields as motor noise from common household appliances with a motor such as electric shavers and hairdryers.

The control signal for outputting the magnetic field detection pulse SP1 is supplied from the magnetic field detection pulse supply part 51*c* to gate GP2 opposite the drive pole (the opposite pole) so that one pole turns on and off. The induction voltage induced in the drive coil 33 by chopper amplification is thus greatly amplified (chopper amplified), the current induced in the drive coil 33 by an ac field is thus sampled as a voltage, and is evaluated by the magnetic field evaluation unit 54 of the detection circuit 52.

A control pulse for outputting the drive pulse P1 at time t3 is supplied from the drive pulse supply part 51*a* of the drive control circuit 51 to gate GN1 and gate GP1. The effective power of drive pulse P1 is reduced to approximately the level at which the rotor 37 rotates so that, for example, a drive pulse P1 of pulse width W10 is supplied at time t3. The control signal for outputting drive pulse P1 can control the effective power by changing the pulse width of the drive pulse, and if complementary pulse P2 is output without the rotor 37 rotating, the pulse width is increased to increase the effective power. On the other hand, if the rotor 37 can be continuously driven a specified number of times at the same pulse width, the pulse width can be shortened and the effective power reduced.

The control pulse for outputting rotation detection pulse SP2 for detecting rotor 37 rotation at time t4 is output from the rotation detection pulse supply part 51*b* of the drive control circuit 51 to gate GP1 and gate GS1. This rotation detection pulse SP2 is a chopper pulse with a duty ratio of approximately ½, enabling the induction voltage induced in the drive coil 33 when the rotor 37 rotates to be derived as the output voltage of the rotation detection resistor 45*a*. The voltage of rotation detection resistor 45*a* is compared with setting SV1 by the rotation evaluation unit 53 of detection circuit 52 so that it can be determined if the rotor 37 rotated.

If the induction voltage excited by rotation detection pulse SP2 does not reach the setting SV1, rotor 37 is known to not have rotated, and a control signal for outputting the complementary pulse P2 at time t6 is supplied from the complementary pulse supply part 51*d* of the drive control circuit 51 to gate GN1 and gate GP1. The complementary pulse P2 is a drive pulse of pulse width W20 having effective power greater than drive pulse P1, which has sufficient energy to assure that rotor 37 rotates. In addition to when rotation of the rotor 37 is not detected, this complementary pulse P2 is output instead of drive pulse P1 when a magnetic field is detected by either magnetic field detection pulse SP0 or SP1.

If a magnetic field is present around the stepping motor 32, the magnetic field, i.e., noise, is detected by the rotation detection pulse SP2 even if rotor 37 is not rotating, the rotor rotation could therefore be falsely detected, and movement errors could be induced. Therefore, outputting a complementary pulse P2 that is unnecessary for rotation detection when a magnetic field is detected increases power consumption but prevents movement errors from occurring.

A control pulse for outputting demagnetization pulse PE at time t8 is supplied from the demagnetizing pulse supply part 51*e* of the drive control circuit 51 to gate GN2 and gate GP2. This pulse width is for reducing the residual magnetic flux of the drive coil 33 produced by the complementary pulse P2 with high effective power, and this is accomplished by supplying a pulse of opposite polarity to the complementary pulse P2. Supplying the demagnetization pulse PE completes the cycle rotationally driving the stepping motor 32 one step angle.

The next cycle for rotating the stepping motor 32 one more step angle starts from time t11 one second after time t1. In this cycle MOS 32*b*, 33*b*, and 34*b* on the opposite side from the previous cycle are the drive pole side. As in the previous cycle, pulse SP0 for detecting high frequency magnetic flux noise is output at time t11, and pulse SP1 for detecting ac field noise is output at time t12. If magnetic field noise is not detected drive pulse P1 is then output at time t13. Because complementary pulse P2 was output in the previous cycle the effective power of the drive pulse P1 is increased, and a drive pulse P1 with a wider pulse width W11 than the drive pulse of the previous cycle is output at time t13. The rotation detection pulse SP2 is then output at time t14, and this cycle ends at this point if rotation of the rotor 37 is thereby detected.

Figure 8:
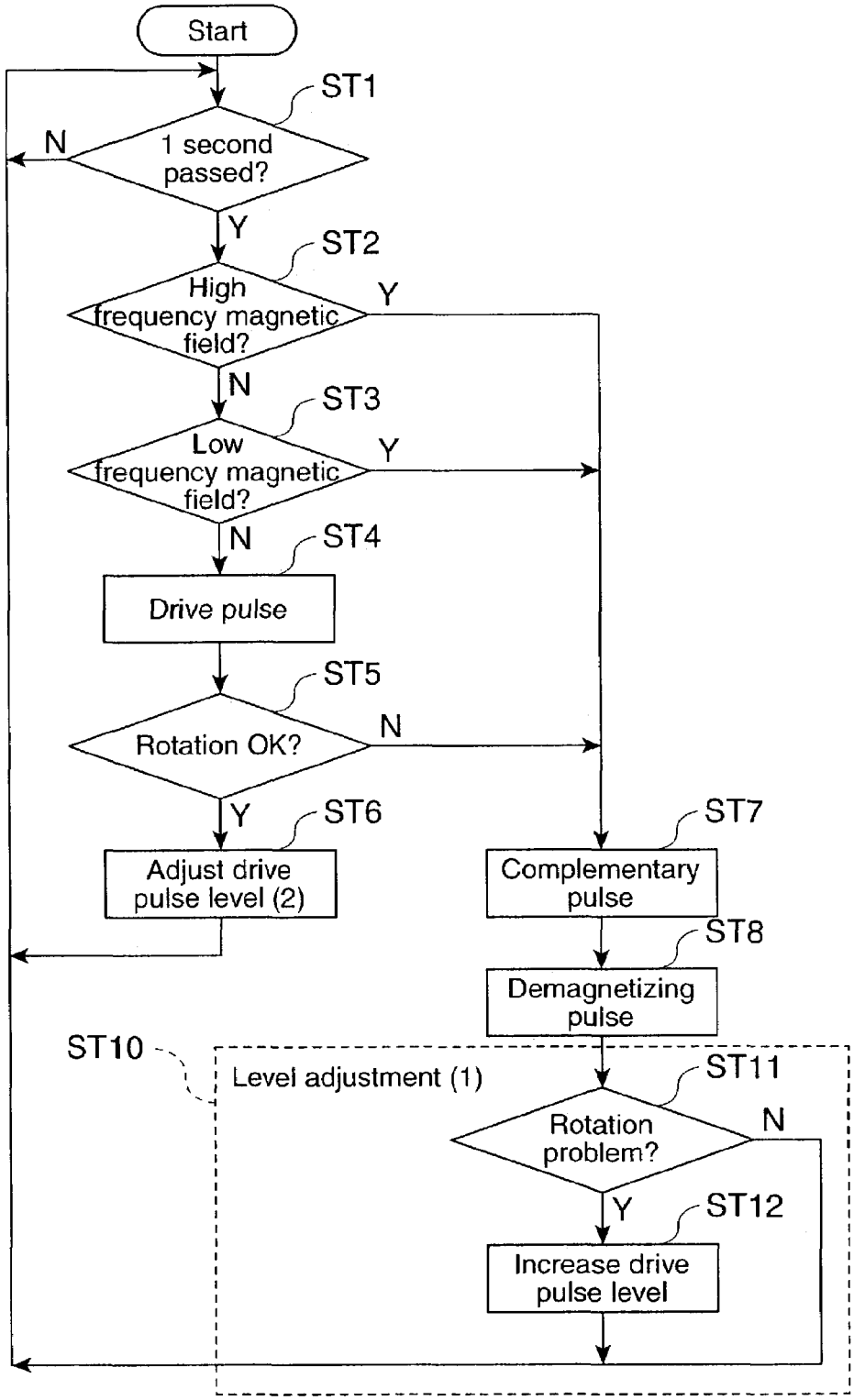
FIG. 8 is a flow chart showing the operation of a control circuit for the first embodiment.

FIG. 8 is a flow chart showing the operation of the control circuit 50 described above. First, reference pulses for timekeeping are counted in step ST1 to measure one second. When one second passes, a high frequency magnetic field is detected using magnetic field detection pulse SP0 in step ST2. If a high frequency magnetic field is detected, complementary pulse P2 with high effective power is supplied instead of drive pulse P1 in step ST7 to prevent movement errors due to false detection. If a high frequency magnetic field is not detected, the presence of an ac magnetic field, that is, a low frequency magnetic field, is confirmed using the magnetic field detection pulse SP1 in step ST3. If an ac magnetic field is detected complementary pulse P2 is output as described above in step ST7 to prevent movement errors.

If a magnetic field is not detected in these steps, drive pulse P1 is output in step ST4 and rotation detection pulse SP2 is then output in step ST5 to confirm the presence of rotor 37 rotation. If rotation cannot be confirmed, complementary pulse P2 with high effective power is supplied in step ST7 to assure that the rotor 37 rotates. When the complementary pulse P2 is output demagnetization pulse PE is output in step ST8, and the level of drive pulse P1 after the complementary pulse is, output is adjusted in step ST10 (first level adjustment). If a rotation problem is detected in step ST5, the same rotation problem will repeat even if a drive pulse P1 of the same effective power is supplied. Therefore, the cause of complementary pulse P2 being output is determined in step ST11, the level is set in step ST12 so that a drive pulse P1 is output at one higher effective power level, the procedure returns to step ST1 and the timekeeping operation runs.

If in step ST5 rotation of the rotor 37 due to drive pulse P1 can be determined, the level of the effective power of drive pulse P1 is adjusted down in step ST6 (second level adjustment). In many cases the rotor 37 is confirmed to rotate plural times with a drive pulse P1 of the same effective power, and the effective power of the drive pulse is lowered. Because by applying such control the power consumption of the drive pulse P1 can be reduced and movement errors can be eliminated even in places where there is a magnetic field from an electrical product, a timekeeping device with high reliability and low power consumption can be provided.

Figure 9:
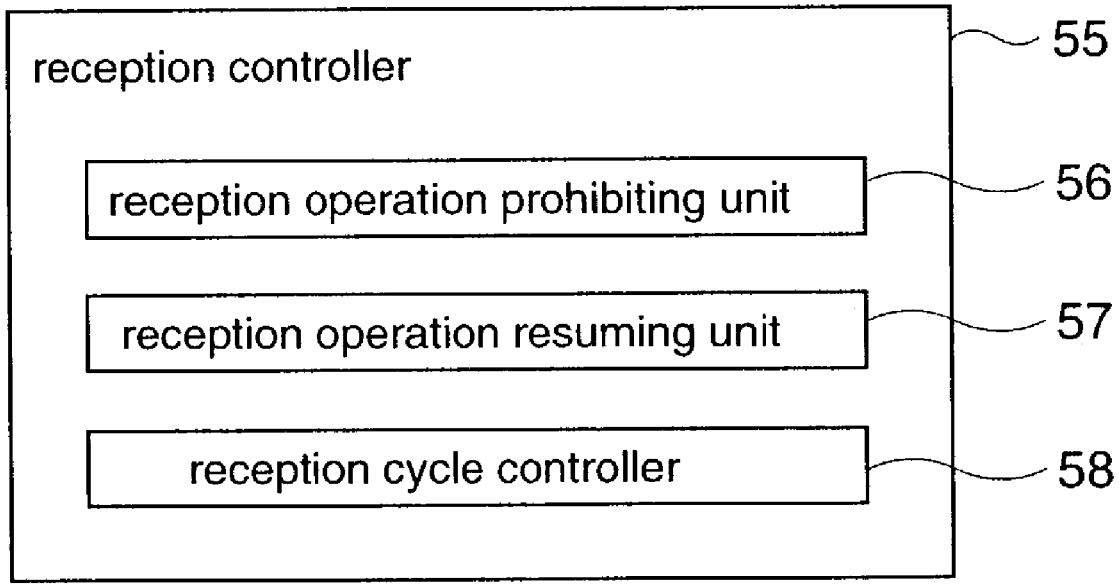
FIG. 9 shows the receiver in accordance with the first embodiment.

The reception controller 55 has a reception operation prohibiting unit 56, a reception operation resuming unit 57, and a reception cycle controller 58 as shown in FIG. 9.

When an external-magnetic-field-detected signal is output from the magnetic field evaluation unit 54, the reception operation prohibiting unit 56 outputs a prohibit-reception-operation signal as the reception control signal to prohibit the reception operation of the receiving circuit 22. When the receiving circuit 22 receives this prohibit-reception-operation signal the reception operation of the receiving circuit 22 is not performed.

When the external-magnetic-field-not-detected signal is output from the magnetic field evaluation unit 54, the reception operation resuming unit 57 outputs a resume-reception-operation signal as the reception control signal to resume the reception operation of the receiving circuit 22. The reception control process is run by this configuration. When the receiving circuit 22 receives the resume-reception-operation signal, the long wave radio signal received by the antenna 21 is signal processed, the time information is sent to the storage circuit 28, and the time information is stored by the storage process.

The reception cycle controller 58 receives time information from the drive control circuit 51, stores schedule information composed of the time for starting the reception operation of the receiving circuit 22 and the time for ending the reception operation, and changes this schedule information according to external magnetic field detection. The schedule information is set to, for example, receive the time information once a day from 2:00 a.m. to 2:05 a.m.

If the external-magnetic-field-detected signal is detected before the reception start time is reached or during reception, the reception operation is prohibited and the reception end time set in the schedule information is invalidated. When the external-magnetic-field-not-detected signal is output, the receiving circuit 22 resumes receiving the time information, and reception is completed when the time information sequence is received for a set time.

It should be noted that the reception operation prohibiting unit 56 and reception operation resuming unit 57 are set to an operating mode from just before the reception start time until reception ends based on the schedule information set in the reception cycle controller 58, and can be set to a non-operating mode at other times in order to reduce power consumption.

An exemplary timing chart showing the relationship between the external-magnetic-field-detected signal and the external-magnetic-field-not-detected signal that are the magnetic field evaluation signals output from the magnetic field evaluation unit 54, and the reception control signal output from the reception controller 55, is shown in FIG. 7(B). In FIG. 7(A), when an external magnetic field is detected by a pulse (high frequency magnetic field detection pulse SP0, ac magnetic field detection pulse SP1) for detecting an external magnetic field the external-magnetic-field-detected signal is output. The external-magnetic-field-detected signal is denoted in the figures by logic high. If an external magnetic field is not detected by the pulses SP0, SP1 for detecting an external magnetic field, the external-magnetic-field-not-detected signal is output. The external-magnetic-field-not-detected signal is denoted in the figures by logic low.

If the external-magnetic-field-detected signal is output when the reception start time is reached based on the schedule information of the reception cycle controller 58, the reception controller 55 outputs a prohibit-reception-operation signal. The prohibit-reception-operation signal is denoted by logic low in the figures.

When the external-magnetic-field-not-detected signal is output, the reception controller 55 outputs the resume-reception-operation signal. The resume-reception-operation signal is denoted as logic high in the figures.

Reception control signal SG1 is output in response to external magnetic field detection by the high frequency magnetic field detection pulse SP0, and reception control signal SG2 is output in response to external magnetic field detection by the ac magnetic field detection pulse SP1. Reception control signal SG3, which is the result of an AND gate combining these reception control signals SG1 and SG2, is output from the reception controller 55 as the final result.

That is, if an external-magnetic-field-detected signal is output due to external magnetic field detection by either SP0 or SP1, the prohibit-reception-operation signal is output by the reception controller 55 and the reception operation is prohibited.

If the external-magnetic-field-not-detected signal is output as a result of no external magnetic field detection by SP0 and SP1, the resume-reception-operation signal is output by the reception controller 55, and the receiving circuit 22 starts the reception operation. The time information is thus received, the stepping motor 32 is driven according to this time information, and the time is adjusted.

Figure 10:
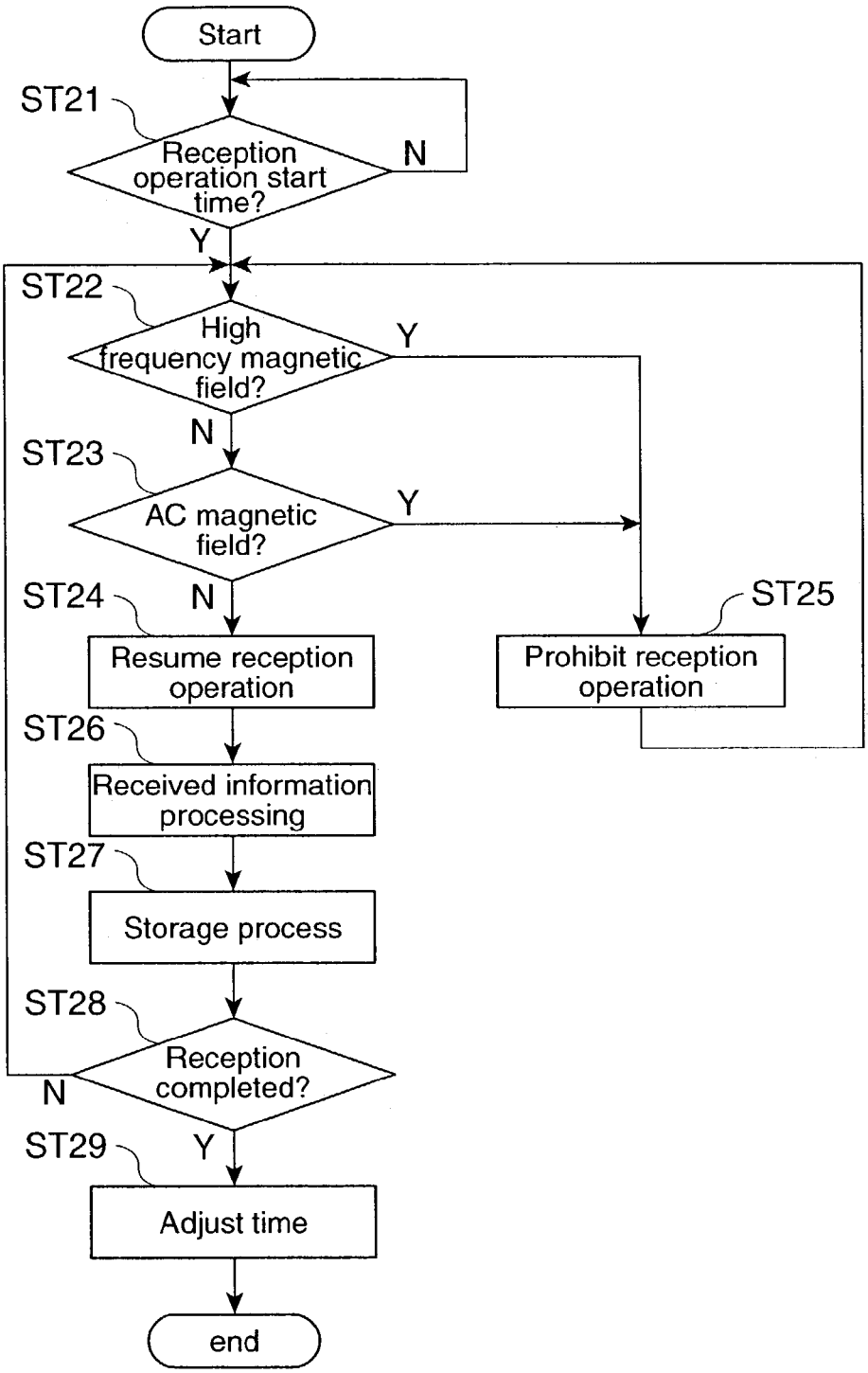
FIG. 10 is a flow chart of time adjustment according to time information reception in the above first embodiment.

A flow chart of time adjustment including operation of the reception controller 55 is shown in FIG. 10.

In the first step ST21 it is determined if it is the reception start time for receiving the long wave standard radio signal. This reception time is the time set as the reception start time in the reception cycle controller 58. An external magnetic field is then detected by the external magnetic field detection process composed of step ST22 for detecting a high frequency magnetic field and step ST23 for detecting an ac magnetic field. This external magnetic field detection process runs at one second intervals. If an external magnetic field is detected by either one of ST22 or ST23, the external-magnetic-field-detected signal is output from the magnetic field evaluation unit 54, and the prohibit-reception-operation signal is output from the reception controller 55. When the receiving circuit 22 receives the prohibit-reception-operation signal, the reception operation of the receiving circuit 22 is prohibited (ST25). When the reception operation is prohibited, magnetic field detection by ST22 and ST23 repeats.

If an external magnetic field is not detected in either external magnetic field detection step ST22 or ST23, an external-magnetic-field-not-detected signal is output from the magnetic field evaluation unit 54, and the resume-reception-operation signal is output by the reception controller 55 to the receiving circuit 22. The reception operation is thus resumed in ST24, the received information processing step ST26 is run by the receiving circuit 22, and the processed time information is stored to the storage circuit 28 in storage step ST27.

Whether a complete time information sequence was stored is then determined in ST28. The time information consists of one frame per 60 seconds, and if the external-magnetic-field-detected signal is output while receiving one frame, reception is prohibited by the reception operation prohibiting unit 56. If one frame is not being received, external magnetic field detection and reception repeat until an external-magnetic-field-not-detected signal is output and time information can be received.

If the time information sequence is stored, the time information is output from the storage circuit 28 to the time adjustment circuit 59 of the central control unit 47, and the time is adjusted in ST29. The time is adjusted by comparing the hand positions detected by the hand-position detection circuit 60 with the received time information, and driving the stepping motor 32 to either advance or reverse the hands so that the hand positions match the received time information.

The embodiment thus described provides the following benefits.

Because an external magnetic field detector including a magnetic field evaluation unit 54 is provided, external magnetic fields can be detected. Because receiving time information by the receiving circuit 22 is thus prohibited by the reception controller 55, falsely receiving time information when in an external magnetic field can be prevented. When an external magnetic field is not detected by the magnetic field evaluation unit 54, receiving time information by the receiving circuit 22 is restarted by the reception controller 55. Accurate time information can therefore be received when an external magnetic field is not present, and the time can be adjusted based on this accurate time information.

A radio-controlled timepiece according to this embodiment of the invention can therefore display the accurate time based only on accurately received time information.

Furthermore, because the reception operation of the receiving circuit 22 is prohibited and the reception operation is not executed when an external magnetic field is detected, wasteful power consumption can be prevented.

By providing a reception cycle controller 58, the receiving circuit 22 can be operated for the set time only. Power consumption can be reduced because the receiving circuit 22 does not operate at other times. By shifting the reception time if an external magnetic field is detected at the set reception time, the reception operation can be started when an external magnetic field is no longer detected. As a result, time information can be accurately received even if there is a slight time lag from the set schedule.

In this embodiment the induction voltage induced in the drive coil 33 of the stepping motor 32 by an external magnetic field is detected by a pulse (SP0, SP1) output from the drive control circuit 51. The external magnetic field detector is configured using the stepping motor that is itself the object of drive control, and the external magnetic field detection result is used for both stepping motor drive control and controlling reception of external wireless information. Because it is therefore not necessary to provide a separate device for external magnetic field detection, and separate external magnetic field detector for controlling stepping motor drive and external magnetic field detector for reception control are not necessary, the radio-controlled timepiece can be reduced in size, the number of parts can be reduced, and cost can be reduced.

Furthermore, a control pulse for accurately driving the stepping motor 32 is supplied based on external magnetic field detection. The stepping motor 32 can therefore be accurately driven even when in an external magnetic field.

Embodiment 2

Figure 11:
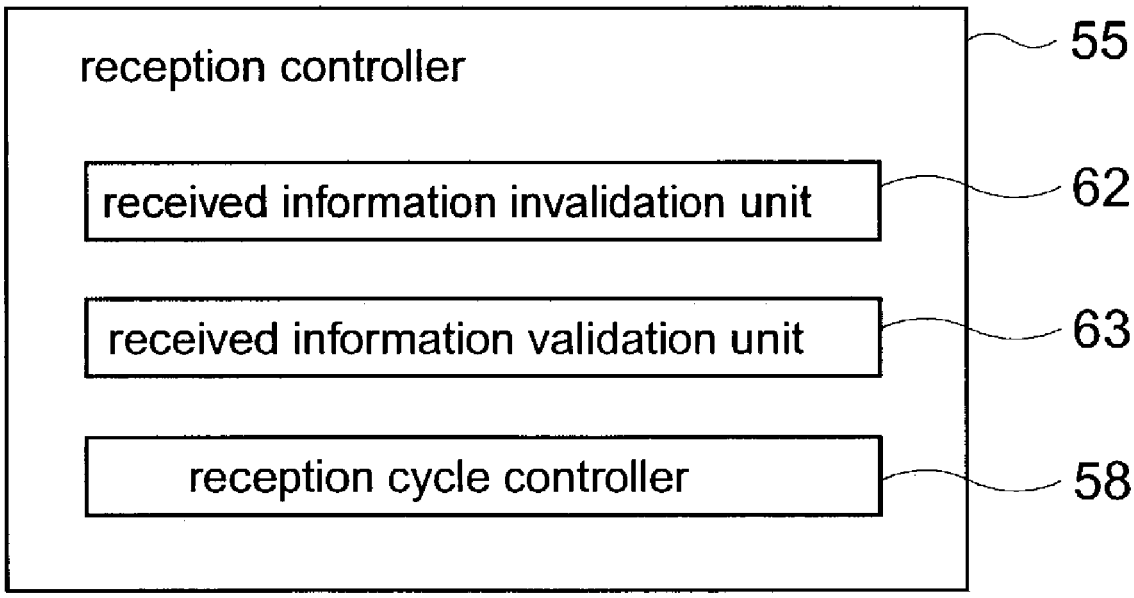
FIG. 11 is a block diagram showing the receiver in accordance with a second embodiment of the invention.

A second embodiment of the present invention is shown in FIG. 11. The basic configuration of the second embodiment is the same as the first embodiment, the second embodiment differing from the first embodiment in that the reception controller 55 is composed of a received information invalidation unit 62, received information validation unit 63, and reception cycle controller 58.

The received information invalidation unit 62 receives the external-magnetic-field-detected signal and outputs a received information invalidation signal, invalidating time information output from the receiving circuit 22. In other words, the time information is not output from the receiving circuit 22 to the storage circuit 28.

The received information validation unit 63 receives the external-magnetic-field-not-detected signal and outputs a received information validation signal to validate time information output from the receiving circuit 22. That is, time information is output from the receiving circuit 22 to the storage circuit 28. Time information stored to the storage circuit 28 is thus output to the time adjustment circuit 59 of the central control unit 47, stepping motor 32 drive is controlled by the drive control circuit 51 according to the time information, and the time is adjusted.

The reception cycle controller 58 is the same as in the first embodiment.

Figure 12:
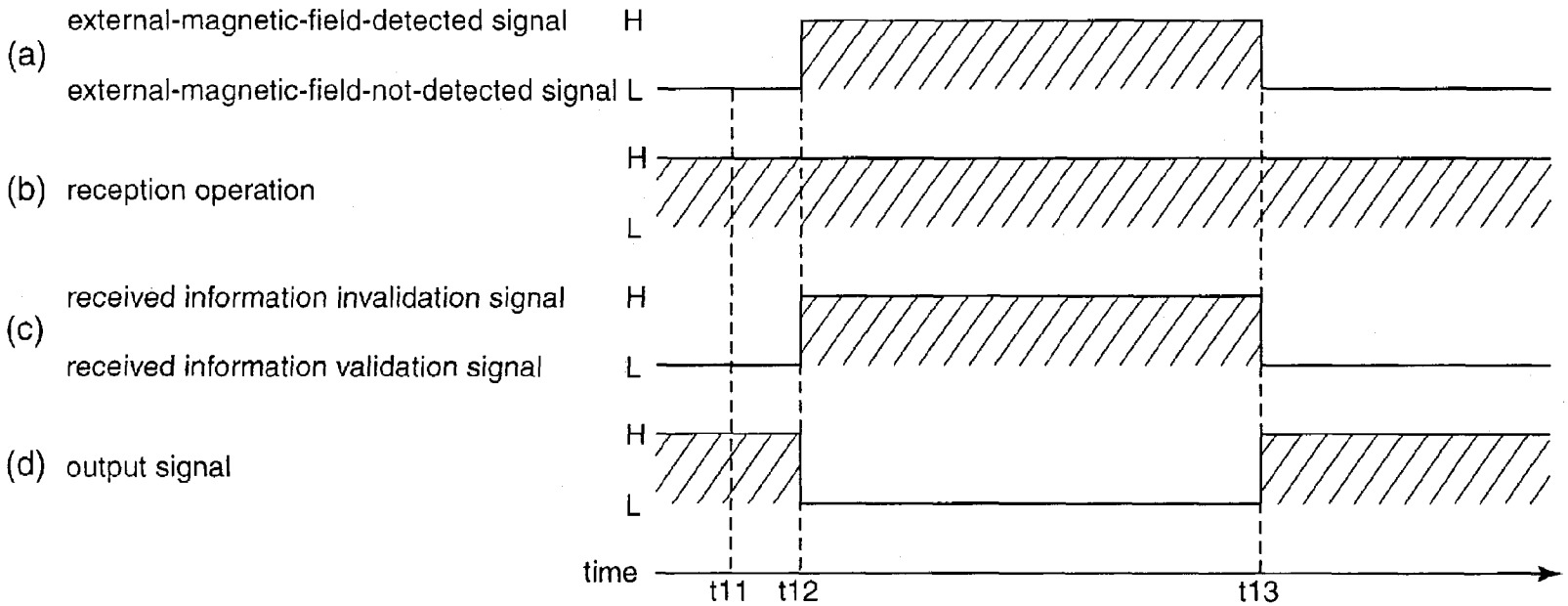
FIG. 12 is a timing chart of the reception control signal according to external magnetic field detection in the second embodiment.

A timing chart of the reception control signal output from the reception controller 55 when detection of an external magnetic field by the magnetic field evaluation unit 54 is received is shown in FIG. 12.

As shown in FIG. 12(*b*), the receiving circuit 22 runs the reception operation when it becomes the set reception time. With this operation the receiving circuit 22 receives the time information when the external-magnetic-field-not-detected signal is output as shown in FIG. 12(*a*), of course, and also when the external-magnetic-field-detected signal is output.

If the external-magnetic-field-not-detected signal is output at t11, the received information validation signal is output by the received information validation unit 63 as shown in FIG. 12(*c*), and the time information is output from the receiving circuit 22.

If the external-magnetic-field-detected signal is output at t12, the received information invalidation signal is output from the received information invalidation unit 62 as shown in FIG. 12(*c*).

As a result, the time information from this period is not output from the receiving circuit 22 as shown in FIG. 12(*d*).

If the external-magnetic-field-not-detected signal is output at t13, the received information validation signal is output by the received information validation unit 63, and the time information is output from the receiving circuit 22. The output time information is stored to the storage circuit 28, and reception ends when reception. of a complete time information sequence is completed. The time is then adjusted according to the time information stored to storage circuit 28.

Figure 13:
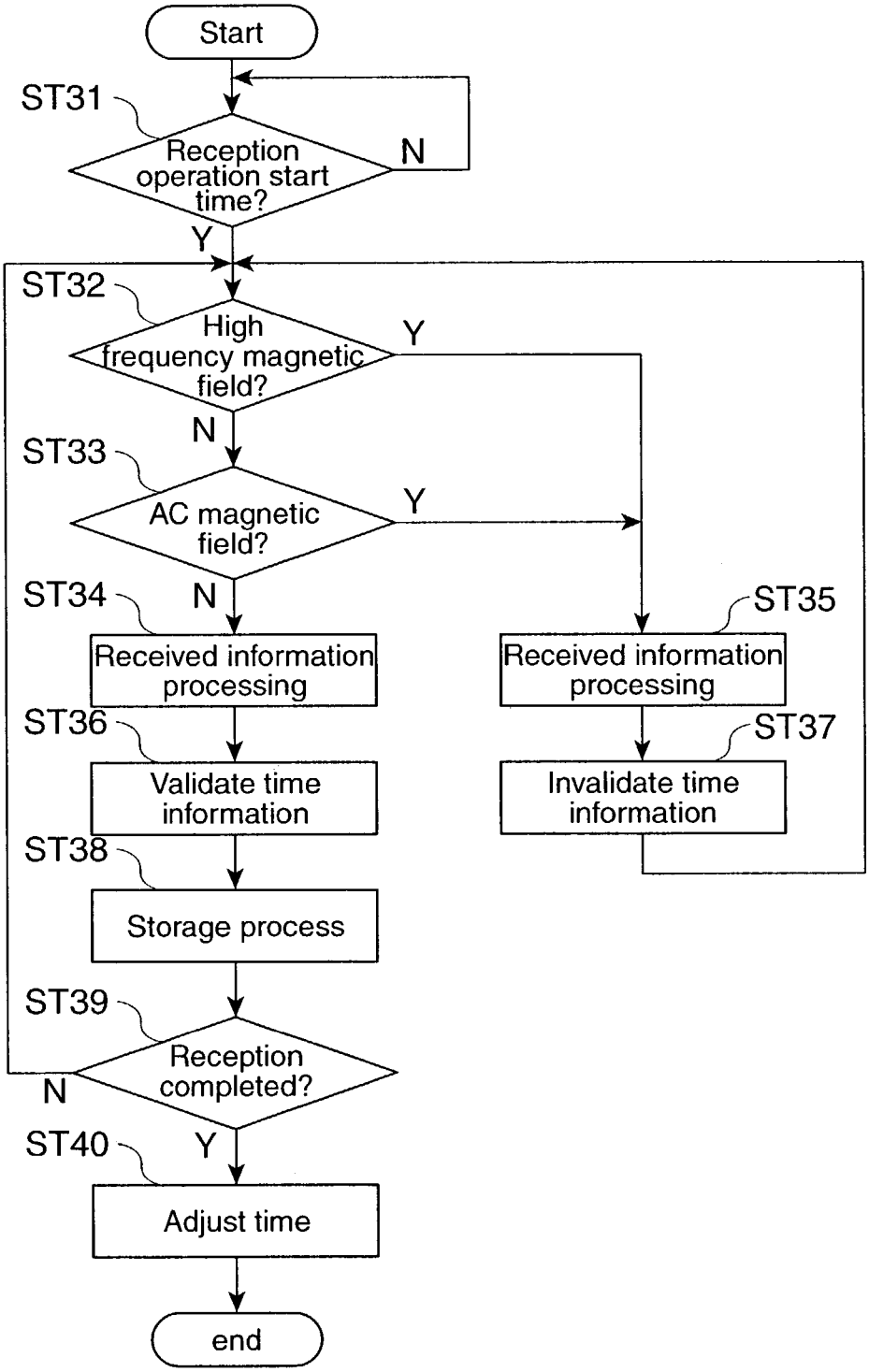
FIG. 13 is a flow chart of time adjustment according to time information reception in the second embodiment.

A flow chart of time adjustment including operation of the reception controller 55 is shown in FIG. 13. In ST31 the reception cycle controller 58 determines if the reception time has come. An external magnetic field is then detected by ST32 for detecting a high frequency magnetic field and ST33 for detecting an ac magnetic field. The received information processing step of ST35 runs even if an external magnetic field is detected in ST32 and ST33. The processed information is then invalidated in ST37 immediately after the received information processing step in ST35. If an external magnetic field is not detected in ST32 or ST33, the received information processing step of ST34 runs and the processed time information is validated in ST36.

The validated time information is stored to the storage circuit 28 in ST38. Operation thereafter is the same as in the first embodiment.

When an external magnetic field is detected by the second embodiment configured as described above the information received by the receiving circuit 22 is not stored to the storage circuit 28 due to the received information invalidation unit 62. That is, information received by the receiving circuit 22 when there is an external magnetic field around the antenna 21 and the time information cannot be correctly received is invalidated and not used. It is therefore possible to prevent displaying the wrong time due to erroneous data mistakenly received.

When an external magnetic field is not detected the information received by the receiving circuit 22 is validated by the received information validation unit 63. That is, only time information accurately received when an external magnetic field does not surround the antenna 21 is used. As a result, the time can be correctly adjusted based on this accurate time information.

Because the time information is received by the receiving circuit 22 regardless of whether or not there is an external magnetic field and the external wireless information is simply not stored to the storage circuit 28 when there is an external magnetic field, switching the circuits on/off is not necessary. The received time information can therefore be soon validated when the external magnetic field is no longer detected, and the information can be immediately processed.

Embodiment 3

A third embodiment of the invention is shown below.

The basic configuration of this third embodiment is the same as the first embodiment, the third embodiment differing from the first embodiment in that the reception controller 55 consists of the reception cycle controller 58, and the reception operation prohibiting unit 56 and reception operation resuming unit 57 are not provided. Furthermore, the reception cycle controller 58 runs and stops the reception operation of the receiving circuit 22 based on set schedule information, invalidates the termination process of the reception operation based on the schedule information when the external-magnetic-field-detected signal is output during the reception operation, and causes the receiving circuit 22 to run the reception operation repeatedly.

Figure 14:
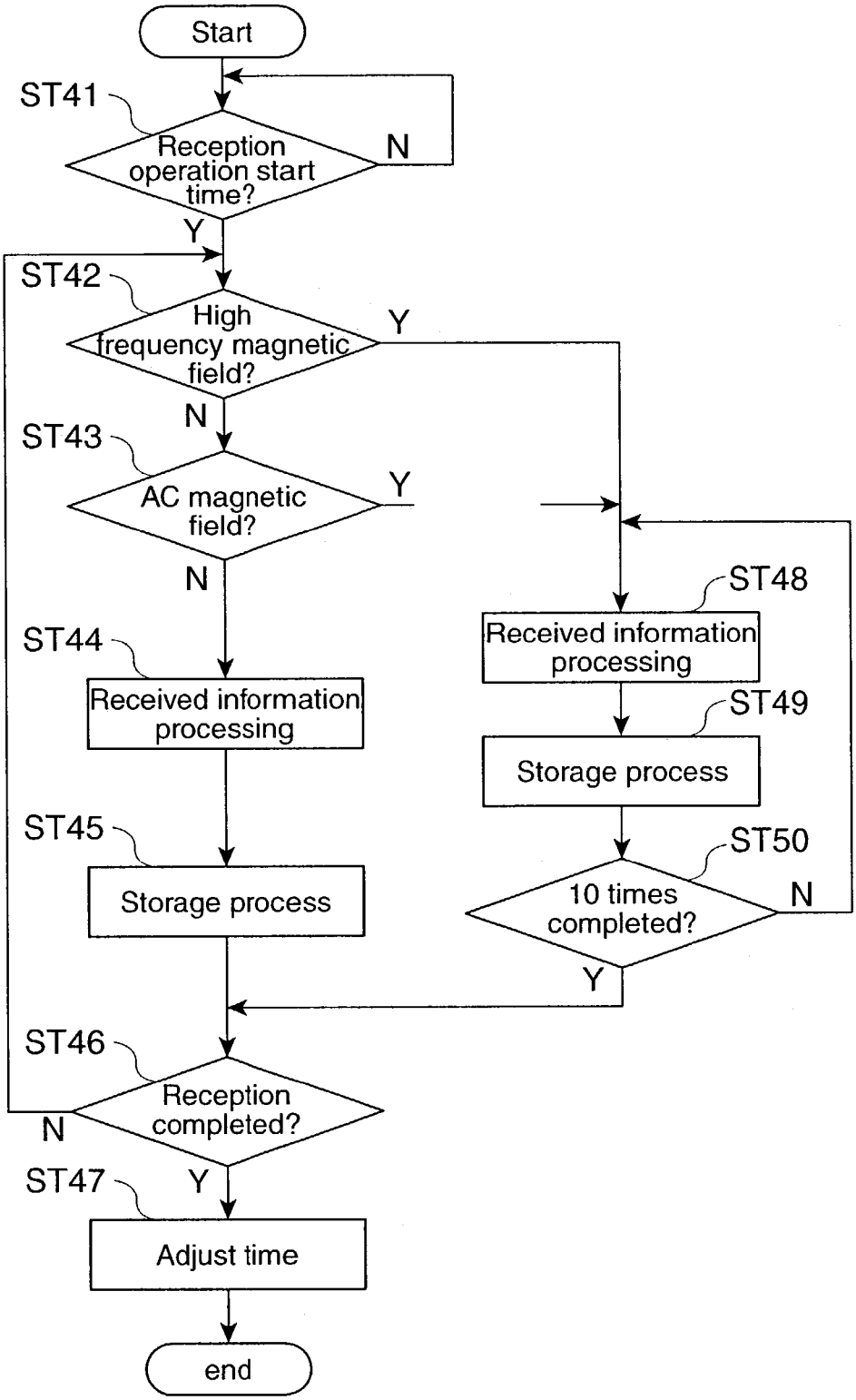
FIG. 14 is a flow chart showing a third embodiment of an electronic device according to the present invention.

A flow chart including operation of the reception controller 55 is shown in FIG. 14. In ST41 the reception cycle controller 58 determines if the reception time has come. If an external magnetic field is not detected in ST42 or ST43, the received information processing step is run by the receiving circuit 22 in ST44, and the processed time information is stored to the storage circuit 28 in ST45. Subsequent operation is the same as in the first embodiment.

If an external magnetic field is detected in ST42 or ST43, the received information processing step is run in ST48, and the processed time information is stored to the storage circuit 28 in ST49. ST48 and ST49 repeat until ST50 counts ten times. Whether the received time information is received accurately is determined in ST46. More specifically, because the time information consists of one frame per 60 seconds, it is determined whether the time information is for a precise 60-second interval. If a specific number of the ten time information frames obtained through ten receptions is received as 60-second interval time information, the information is determined to have been correctly received. Subsequent operation is as in the first embodiment.

Thus comprised the reception operation repeats when an external magnetic field is present. Because the reception operation is performed repeatedly even when in an external magnetic field, the likelihood that the time information can be accurately received even when exposed to an external magnetic field can be increased. The time is then adjusted when the time information is accurately received. The time information can therefore be regularly received even when in an external magnetic field, and the time can be adjusted.

Embodiment 4

Figure 16:
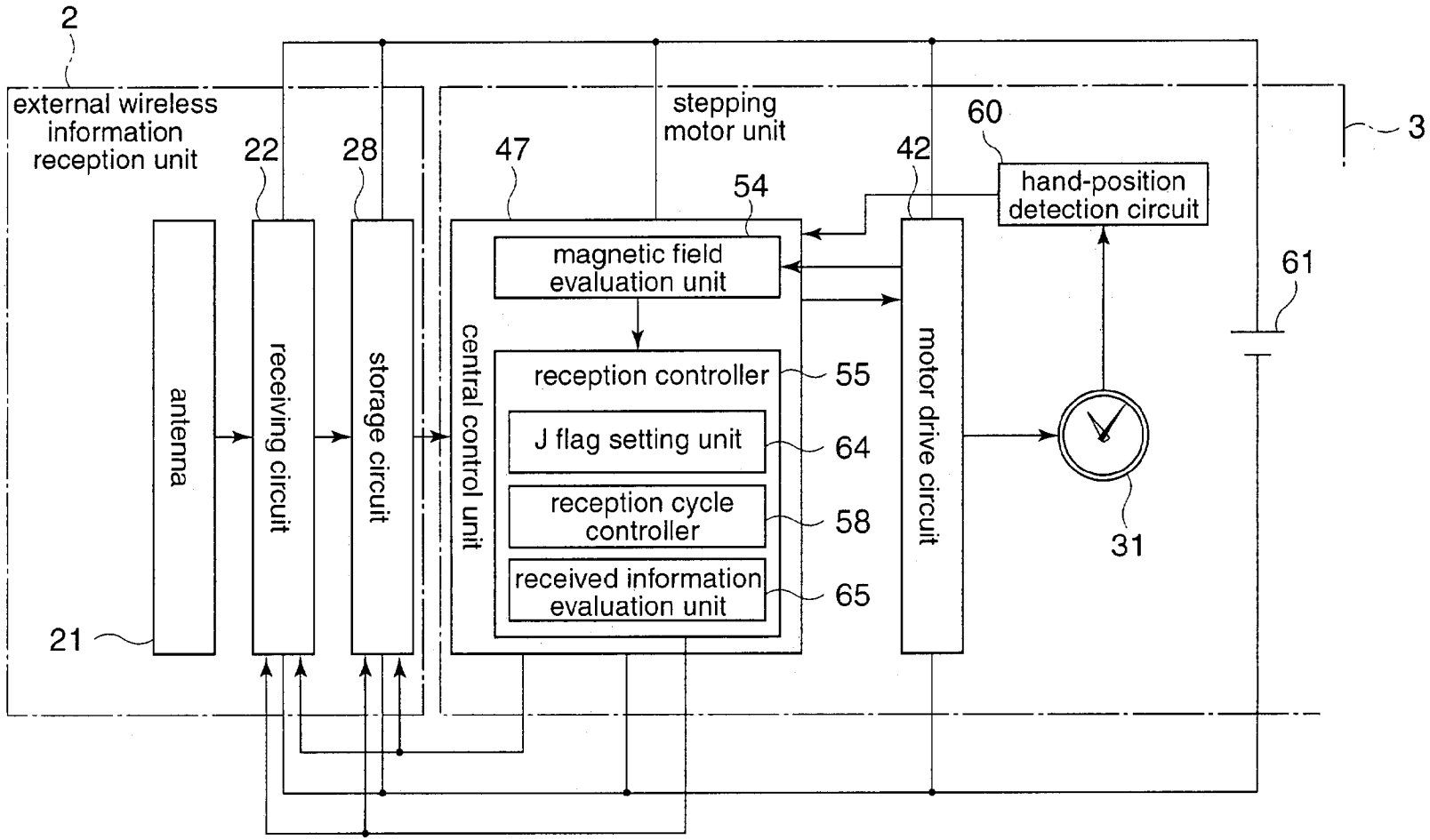
FIG. 16 is a block diagram of a fourth embodiment of an electronic device according to the present invention.

A fourth embodiment of the present invention is shown in FIG. 16. The basic configuration of this fourth embodiment is the same as the first embodiment and second embodiment, but the fourth embodiment differs from the first embodiment and second embodiment in that the reception controller 55 consists of a J flag setting unit 64, reception cycle controller 58, and received information evaluation unit 65.

The reception controller 55 consists of a J flag setting unit 64, reception cycle controller 58, and received information evaluation unit 65.

Figure 17:
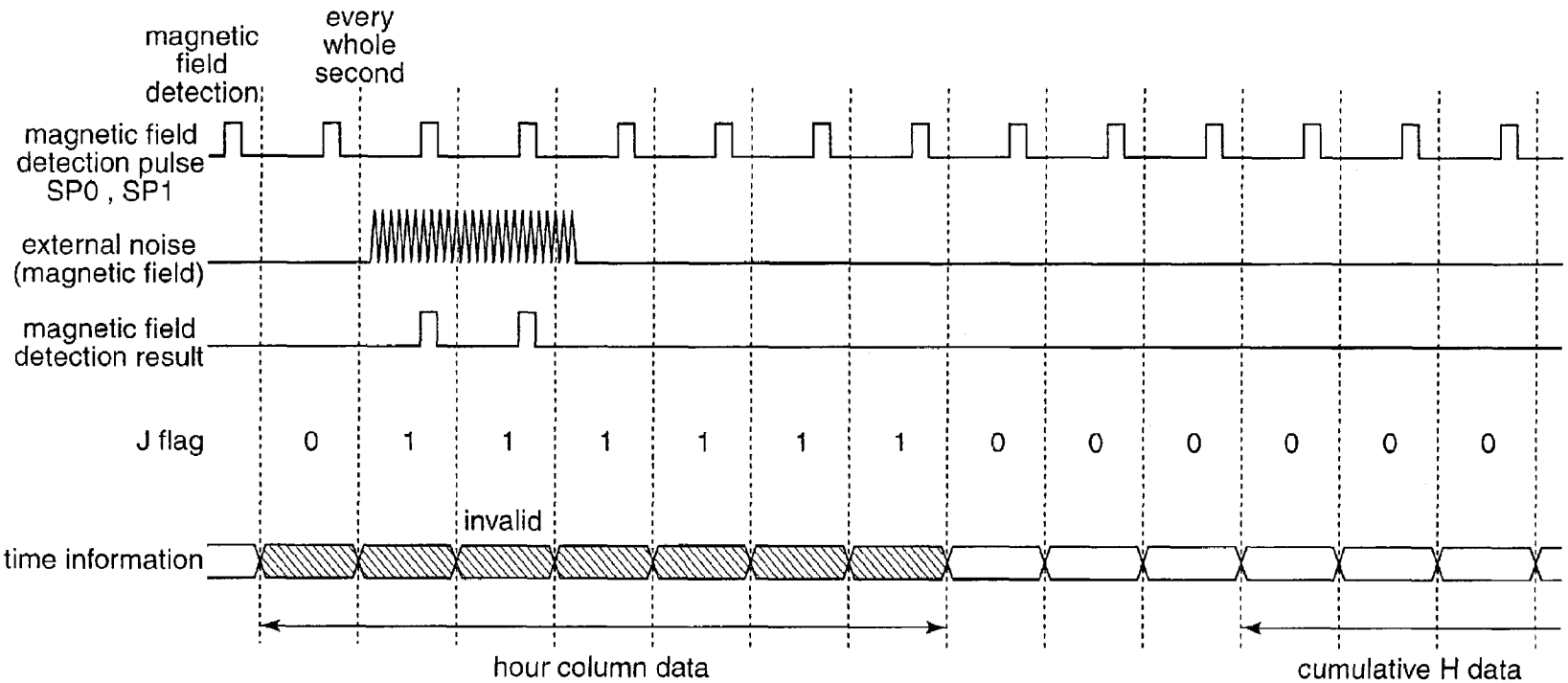
FIG. 17 shows the relationship between invalidated column data and J flags set according to external magnetic field detection in the above fourth embodiment.

The J flag setting unit 64 sets a J flag denoting the presence of an external magnetic field based on the evaluation of external magnetic field presence by the magnetic field evaluation unit 54. The J flag is a binary signal of 0 or 1. When the J flag setting unit 64 receives the external-magnetic-field-not-detected signal from the magnetic field evaluation unit 54, it sets the J flag to 0, and when it receives the external-magnetic-field-detected signal it sets the J flag to 1. For example, as shown in FIG. 17, if an external magnetic field occurs while receiving time information and the external magnetic field is detected by magnetic field detection pulse SP0, SP1, the J flag setting unit 64 sets the J flag to 1.

If an external magnetic field is detected and the J flag is set to 1, the J flag=1 state is held with respect to receiving column data including the bit data of J flag=1. To receive other column data the J flag is reset to 0 and set again according to the presence of an external magnetic field.

The J flag set by the J flag setting unit 64 is stored to the storage circuit 28, and is stored to the storage circuit 28 with the J flag at the time the time information is received added to the time information received by the receiving circuit 22.

As in the first embodiment and second embodiment, the reception cycle controller 58 stores schedule information containing the time for starting the reception operation of the receiving circuit 22 and the time for ending the reception operation, and controls the number of times the time information is received according to the value (0 or 1) of the J flag.

If the J flag is all 0s for the column data for a particular unit, the receiving circuit 22 is controlled to receive the time information until column data for that digit is received twice. If at least one J flag is set to 1 for the column data of a particular digit, the receiving circuit 22 is controlled to receive the time information until column data for that digit is received three times. If particular column data is received three times and the J flag is set to 1 all three times, reception ends after capturing those three times.

The received information evaluation unit 65 determines if the time information stored in the storage circuit 28 has been accurately received and is valid for time adjustment. The received information evaluation unit 65 bases evaluation on a parity check, and by comparing the time information received two time or three times according to the J flag.

The received information evaluation unit 65 determines whether the column data is valid or not by applying a parity check to each column data of the time information stored in the storage circuit 28. For example, the long wave standard radio signal contains signals used for a parity check of the minute column data and hour column data. In FIG. 2 PA1 is the parity bit for hour column data and PA2 is the parity bit for minute column data. The long wave standard radio signal is even parity, and the signal is transmitted so that the number of 1s in the column data bits and parity bits is even. Therefore, if the minute column data, hour column data, and parity bits are surveyed and the data bits are even parity, the column data is determined in the parity check to be valid.

If the parity check is valid the received information evaluation unit 65 compares the time information received two or three times according to the value of the J flag on a column data basis, and determines for each column datum whether it is valid or invalid.

If the column data received twice consecutively for column data to which a 0 J flag is added matches, the received information evaluation unit 65 determines this column data is valid. For example, if it is the minute column data and the minute column data received twice consecutively has a time difference of one minute, it is determined valid. Furthermore, if it is the hour column data or year column data and the two consecutive hour column or year column data match, the data is determined valid. It will be obvious, however, that if the time when the hour or year changes is spanned then a shift of one hour or one year is acceptable.

If the column data received three times consecutively for column data to which a 1 J flag is added matches, the received information evaluation unit 65 determines this column data is valid. For example, if it is the minute column data and the minute column data received three times consecutively has a sequential time difference of one minute, it is determined valid.

If the column data is determined valid, the column data is output from the storage circuit 28 to the time adjustment circuit 59, and the time is adjusted.

If the column data and the data bits of the parity bits are not even parity in the parity check, the received information evaluation unit 65 determines the column data invalid. Even if the column data is determined valid in the parity check, consecutively received column data that does not match is determined invalid. Column data determined invalid is cleared from the storage circuit 28 in column data units as shown in FIG. 17.

The receiving circuit therefore receives the time information again, and the cleared part of the column data is completed.

Figure 18:
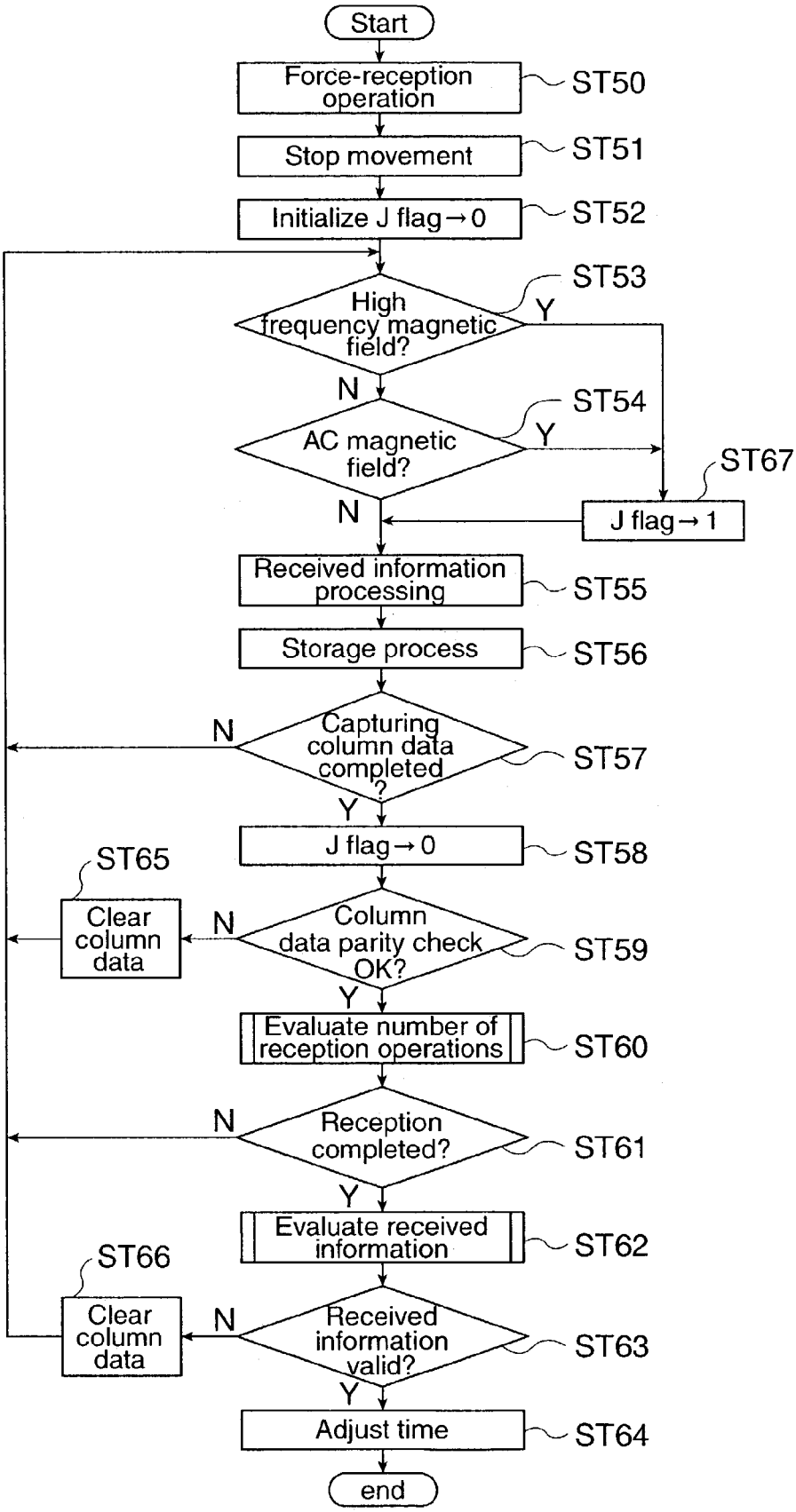
FIG. 18 is a flow chart of time adjustment according to time information reception in the above fourth embodiment.
Figure 19:
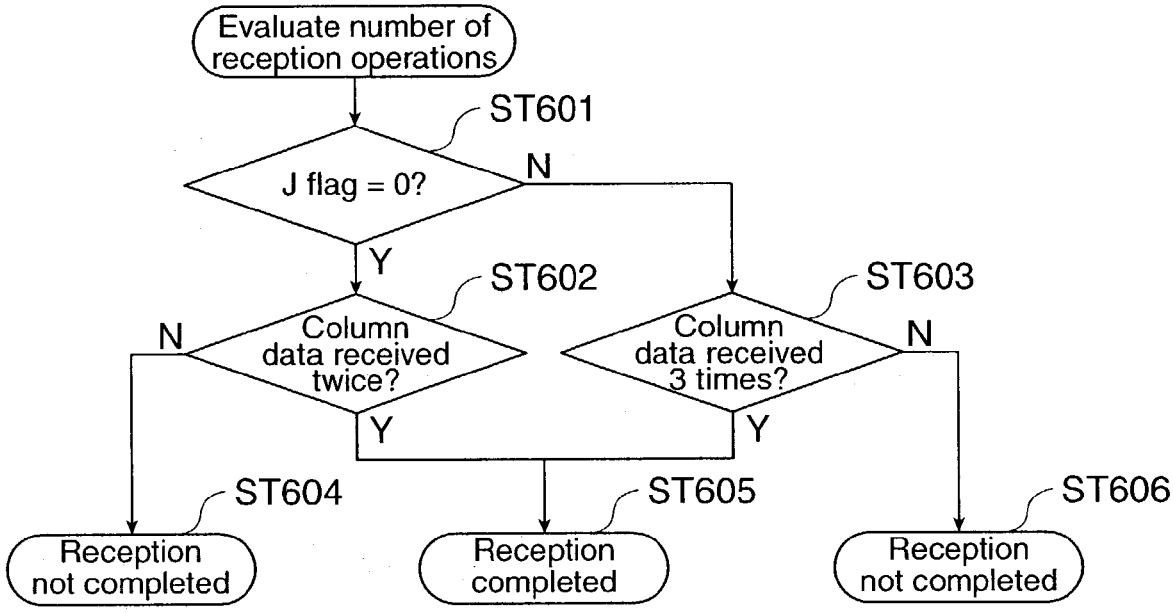
FIG. 19 is a flow chart of the reception count evaluation in the above fourth embodiment.
Figure 20:
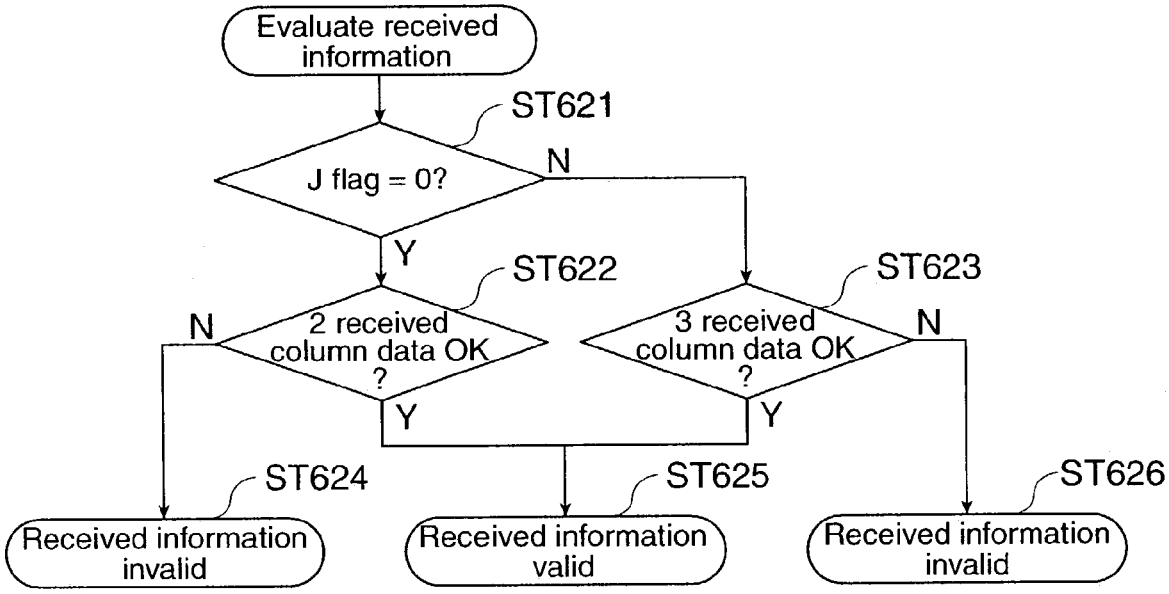
FIG. 20 is a flow chart of received information evaluation in the above fourth embodiment.

The operation of the fourth embodiment is described using the flow charts in FIG. 18, FIG. 19, and FIG. 20.

To receive time information and adjust the time, the user first performs a force-reception operation to force starting the reception operation for time adjustment (ST50). This force-reception operation unit to start the reception operation even though it has not reached the reception time set in the reception cycle controller 58 by operating an external operating unit such as the crown disposed on the outside of the radio-controlled timepiece 1. It should be noted that starting reception shall not be limited to the force-reception operation (ST50), and could be automated reception starting reception automatically when a specific time is reached.

Movement of the hands (second hand 39, minute hand 40, hour hand 41) stops (ST51) if, the force-reception operation ST50 is performed. That is, drive pulses from the control circuit 50 to the drive coil 33 of the stepping motor 32 stop. The J flag of the J flag setting unit 64 is initialized to 0 (ST52). An external magnetic field detection process is then run by means of ST53 for detecting a high frequency magnetic field, and ST54 for detecting an AC magnetic field. This external magnetic field detection process is the same as described in the first embodiment, and runs at one second intervals.

If a magnetic field is not detected by the external magnetic field detection process ST53, ST54, the received information process step ST55 is run by the receiving circuit 22 with the J flag set to 0. If a magnetic field is detected by the external magnetic field detection process ST53, ST54, the J flag is set to 1 (ST67), and the received information process step ST55 is run.

The time information received and processed by the receiving circuit 22 is stored to the storage circuit 28 together with the state of the J flag when the time information was received, that is, together with the 0 or 1 state of the J flag.

Next, the received information evaluation unit 65 determines if all column data has been stored to the storage circuit 28, that is, whether receiving all column data has finished (ST57). If the column data is stored, the J flag is reset to 0 (ST58). The J flag is thus set for the data of each column.

The parity of the column data stored to the storage circuit 28 is then checked (ST59). Once the minute column data signals have been received (ST57), for example, the received information evaluation unit 65 runs a parity check on the minute column data stored to the storage circuit 28. A parity check is done for column data having a parity check bit; with the long wave standard radio signal, for example, a parity check is applied to the hour column data and minute column data, and the parity check of the cumulative days and year is always assumed to be valid. The parity is checked, and if the data bit parity of the column data and parity bit match a predefined parity, the column data is determined valid by the parity check.

Next, the received information evaluation unit 65 performs a reception count evaluation (ST60) to determine how many column data samples have been stored for the column data determined valid in the parity check step (ST59) and the column data presumed to be valid because a parity check is not provided for and is not performed. This reception count evaluation is described using FIG. 19. Whether the J flag added to the column data on which the reception count evaluation is performed is set to 0 or 1 is confirmed first (ST601). If all J flags for the column data are set to 0 (ST601 returns yes), whether that column data was received twice consecutively is determined (ST602). If column data having the J flag set to 0 has already been received twice consecutively, reception of that column data is considered finished.

If in ST601 the J flag is set to 1 for even just one column data (ST601 returns no), whether that column data has been received three times consecutively is determined (ST603). If column data for a column containing at least one J flag set to 1 has been received three times consecutively, reception of that column data is considered finished.

If in ST602 column data with the J flags set to 0 has not been received twice consecutively, or in ST603 column data for a column containing a J flag set to 1 has not been received three times consecutively, reception of that column data is considered not finished (ST604, ST606).

If column data reception is determined completed in the reception count evaluation in ST60, and receiving all column data such as the minute column data, hour column data, cumulative days column data, and year column data is determined completed (ST61), the received information evaluation unit 65 compares and evaluates the time information received two or three times according to the J flags (ST62).

Evaluation of received information according to the J flag is described using FIG. 20.

Whether the J flag added to the column data to be evaluated is set to 0 or 1 is confirmed first (ST621). If all J flags for the column data are set to 0 (ST621 returns yes), whether the twice consecutively received column data matches is determined (ST622), and if it does the column data is determined valid (ST625).

If in ST621 the J flag is set to 1 for even just one column data, whether the column data received three times consecutively matches is determined (ST623), and if it matches the column data is determined valid (ST625).

If the two consecutively received column data do not match for column data having the J flag set to 0 in ST622, or the three consecutive column data do not match for column data having a J flag set to 1 in ST623, the column data is considered invalid (ST624, ST626).

Column data validity/invalidity is determined in the received information evaluation of ST62, and if all column data such as the minute column data, hour column data, cumulative days column data, and year column data is considered valid (ST63), the time information stored to the storage circuit 28 is output to the time adjustment circuit and the time is adjusted (ST64).

If it is determined in ST57 that a column data set could not be captured to the storage circuit 28, the external magnetic field detection steps of ST53 and ST54, received information processing step ST55, and storage step ST56 are run, and time information is received until the missing column data is received. If an external magnetic field is detected just once in the external magnetic field steps of ST53 and ST54 while performing the operations from ST53 to ST57, the J flag is set to 1 the moment the external magnetic field is detected. When the J flag is set to 1, the column data is received while holding the J flag=1 state.

If in the parity check in ST59 the data bit parity of the column data and parity bit does not match a predefined parity, the column data is cleared from the storage circuit 28 (ST65), ST53 to ST59 repeat, and the time information is received until column data with a valid parity check is received.

If ST61 determines that the number of column data sets determined by the J flag states have not been received, that is, reception is not completed (ST604, ST606), ST53 to ST61 repeat, and time information is received until the column data has been received the number of times determined by the J flag states.

If in ST63 the consecutively received column data does not match and the column data is determined invalid (ST624, ST626), that column data is cleared from the storage circuit 28 (ST66), ST53 to ST63 repeat, and reception continues until the consecutively received column data matches.

When reception returns to ST53 from ST57, ST59, or ST63, only the necessary column data could be stored to the storage circuit 28 considering the data already stored to the storage circuit 28. For example, only the column data cleared in ST65 or ST66 could be stored.

This fourth embodiment thus comprised offers the following effects.

Movement of the hands stops when receiving time information (ST51). That is, the drive pulse for driving the rotor 37 of the stepping motor 32 stops, and time information is received in a state in which an induction field is not produced in the drive coil 33 of the stepping motor 32. An induction field from the drive coil 33 therefore does not influence the time information, and time information can be accurately received. Because the time can be adjusted after receiving the time information is finished even if driving the stepping motor 32 stops while the time information is being received, the user is not greatly inconvenienced even if rotor drives stops for the short time needed to receive the time information. Further, because an induction field is not produced from the drive coil 33 as a result of stopping the rotor 37 drive pulse, the time information can be accurately received.

A parity check is applied to each set of column data in the received time information and whether each column data set is valid or invalid is determined (ST59), and column data for which the data bits of the column data and parity bit do not match a preset parity in the parity check is cleared from the storage circuit 28 (ST65). Because a reception error is known to have occurred if the parity check does not indicate valid data, a wrong time adjustment using erroneously received time information can be prevented by clearing column data indicated as invalid by the parity check. Furthermore, because applying a parity check to each column data set is a common technique, a common algorithm can be used, and the circuit configuration and program can be simplified.

If an external magnetic field is detected when receiving the time information, a J flag set to 1 is added to the time information by the J flag setting unit 64 and stored to the storage circuit 28. The number of compared column data varies according to whether this J flag is set to 0 or 1. That is, because the likelihood is high that signal reception is accurate when there is no external magnetic field, the number of column data compared can be reduced and the time can be efficiently adjusted. On the other hand, because receiving the time information is attempted even when there is an external magnetic field without prohibiting or invalidating reception from the start after recognizing that an external magnetic field is present, the time can be quickly adjusted even when there is an external magnetic field if the signal can be normally received. Furthermore, while the likelihood is high that the time information will be erroneously received when there is an external magnetic field, setting the wrong time based on falsely received time information can be prevented because data validity/invalidity is carefully determined after increasing the number of compared column data.

Therefore, compared with prohibiting or invalidating reception from the start, the efficiency and likelihood of the time adjustment can be improved even in an external magnetic field.

Because only the needed column data is stored to the storage circuit 28 considering the data already stored in the storage circuit 28 even when the time information is processed by column data unit and receiving returns from ST57, ST59, or ST63 to ST53, the power required for time adjustment can be reduced compared with invalidating one whole time information frame.

It should be noted that an electronic device according to the present invention shall not be limited to the embodiments described above. Rather, the invention is intended to embrace many variations, some of which are described below.

Figure 15:
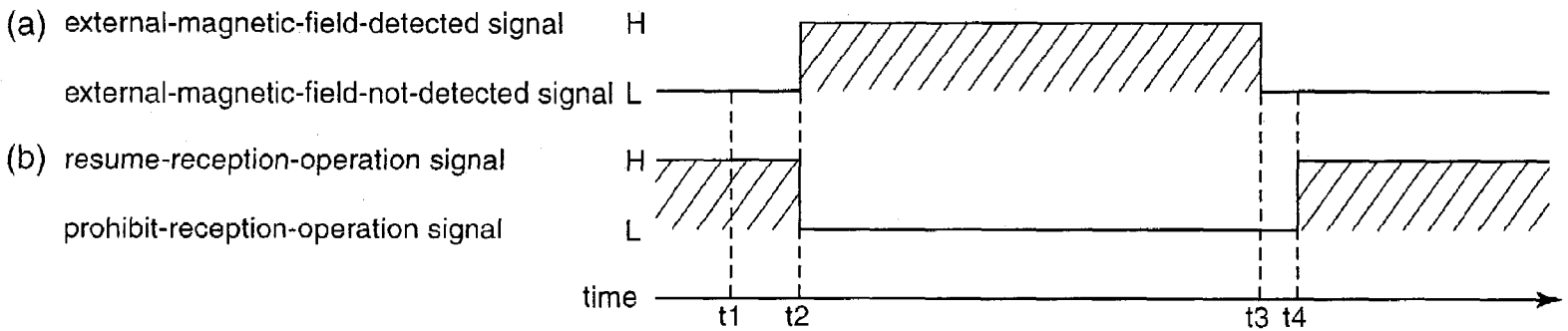
FIG. 15 is a timing chart for a case in which the reception operation is resumed after a specific time passes after the external-magnetic-field-detected signal is received.

In the first embodiment the receiving operation is restarted when the external magnetic field external-magnetic-field-not-detected signal is output, but the receiving operation could be restarted after waiting a specific period after the external-magnetic-field-not-detected signal is output. As shown in FIG. 15 the resume-reception-operation signal is output from t4 to resume reception at a specific time after the external-magnetic-field-not-detected signal is output at t3.

By thus waiting a specific time after the external-magnetic-field-not-detected signal is output, the reception operation can be resumed after reliably determining that an external magnetic field is not present.

In the second embodiment it is likewise possible to validate the time information after waiting a specific time after the external-magnetic-field-not-detected signal is output.

In the second embodiment received time information is not output from the receiving circuit 22 to the storage circuit 28 when a received information invalidation signal is output, but after output to the storage circuit 28 time information stored while the external-magnetic-field-detected signal is output could be deleted and thereby invalidated. Stopping output from the receiving circuit 22 requires turning the circuit on and off, but deleting stored data can be easily accomplished by an operation on the memory of the recording medium.

One entire time information frame could be invalidated in order to invalidate data when the external-magnetic-field-detected signal is output, but it is alternatively possible to invalidate only the bit data received when the external-magnetic-field-detected signal is output, or to invalidate the bit data including the one or two bits before and after the bit data received when the external-magnetic-field-detected signal is output. It is then possible to receive and complete only the invalidated data when data is next received. It is therefore possible to reduce the invalidated data and reduce the data that must be stored in the reception operation. The power required to receive time information can therefore be reduced.

If the J flag is set to 1 even only once while receiving particular column data, the J flag is held set to 1 in the fourth embodiment, but the J flag could, for example, be set for each data bit. That is, the state of the J flag set when receiving each data bit while receiving the time information could be added to and stored with the data bit to the storage circuit 28.

When data is determined invalid by the evaluation in ST59 or ST63, it is also possible to invalidate and clear from the storage circuit only the data bits for which the J flag is set to 1. This configuration minimizes the data to be cleared and minimizes the data that must be stored during the reception operation.

Figure 21:
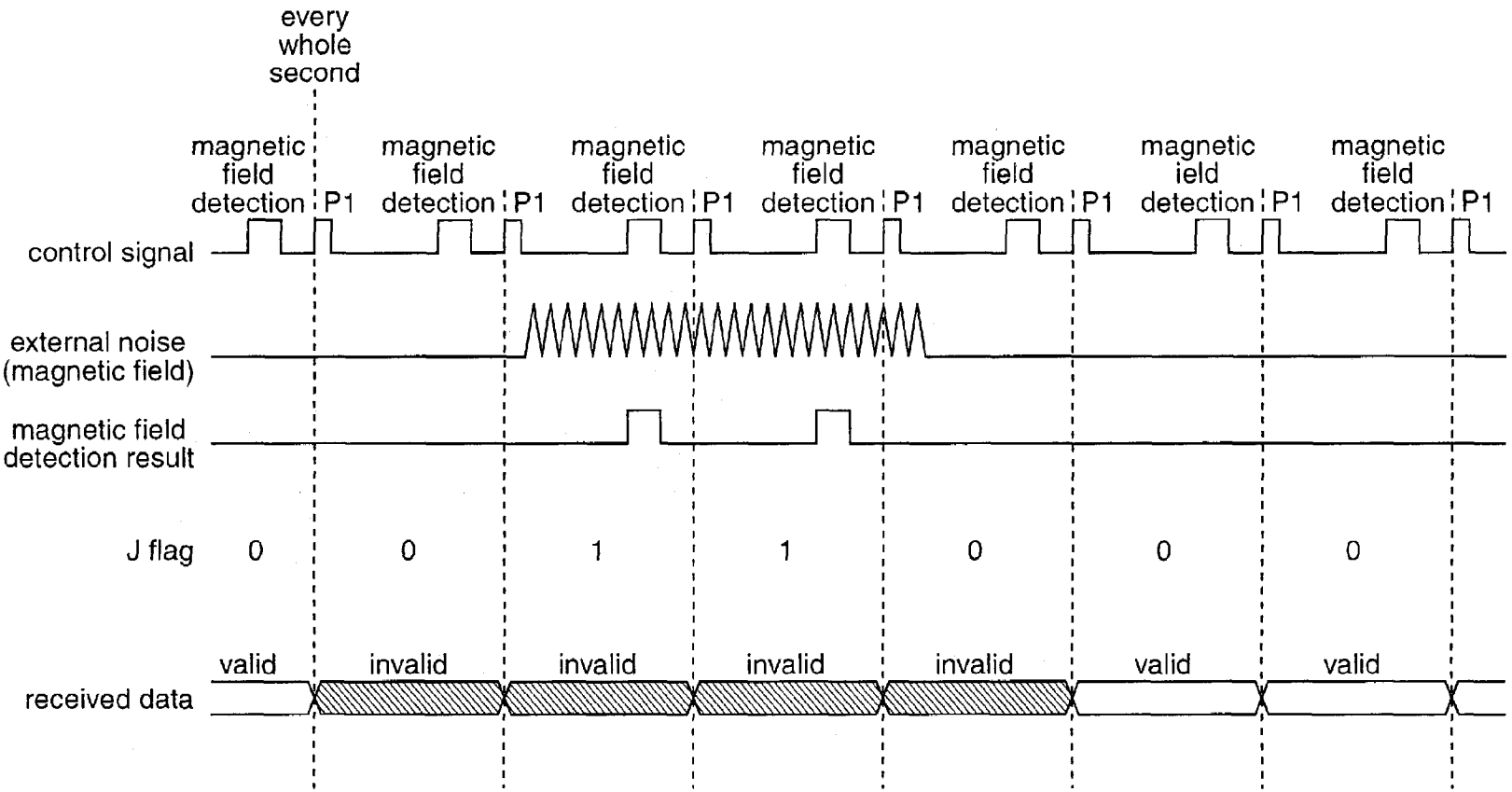
FIG. 21 shows valid/invalid evaluation by data bit as a variation of the above fourth embodiment.

It is therefore possible to minimize the power required for time adjustment. Furthermore, as shown in FIG. 21, it is also possible to clear the bit data before and after the bit data for which the J flag is set to 1 from the storage circuit 28. This configuration makes it possible to reliably clear bit data possibly subject to the effects of an external magnetic field even when an external magnetic field is not detected by magnetic field detection because the external magnetic field appears and disappears between the period of the magnetic field detection pulse. It is therefore possible to prevent adjusting the time using wrong time information falsely received because of the influence of the external magnetic field. It is also possible to clear the entire time information frame from storage circuit 28 when the J flag is set to 1. It should be noted that FIG. 21 shows an example in which the hands continue moving during reception and drive pulse P1 is output.

The number of receptions is also not specifically limited, and instead of two or three times can be further increased. The number could also be set desirably by the user.

The time information reception operation can start when a preset reception time is reached as in the first, second, and third embodiments, or can be started by a force-reception operation as in the fourth embodiment.

An external magnetic field is detected by detecting an induction voltage induced in the drive coil 33 of the stepping motor 32, but a magnetic sensor could be separately provided as an external magnetic field detector. Driving the stepping motor 32 can be controlled and the reception operation of the receiving circuit 22 can be controlled according to external magnetic field detection by this magnetic sensor.

The stepping motor unit 3 could have two or more stepping motors 32. There could, for example, be a stepping motor for driving the second hand 39, a stepping motor for driving the minute hand 40, and a stepping motor for driving the hour hand 41. In this case an induction voltage could be detected for the drive coil 33 in every stepping motor 32, or an induction voltage could be detected for a specific drive coil 33.

There are two types of magnetic field detection pulses, the high frequency magnetic field detection pulse SP0 and the ac magnetic field detection pulse SP1, but it is also possible to use only one.

Furthermore, it is also possible to provide a threshold value for controlling stepping motor 32 drive and a threshold value for reception control as threshold values (setting SV2) for inverters 54*a* and 54*b* with the central control unit 47 switching the threshold values by means of a transistor or other switching device. In other words, a threshold value for detecting external magnetic fields affecting the reception of external wireless information, and a threshold value that is higher than this threshold value and is used for detecting external magnetic fields affecting driving the stepping motor, could be provided. When two such threshold values are provided the threshold value for reception control and the threshold value for drive control of the stepping motor 32 can be switched for magnetic field detection in the first part or latter part of magnetic field detection pulses SP0 and SP1. When the reception time for receiving external wireless information is preset, the threshold value is set to the level for drive control of the stepping motor 32 when external wireless information is not received, and can be set to the threshold value for detecting external magnetic fields affecting reception of external wireless information in order to receive external wireless information.

Control can thus be optimized for reception control and drive control of the stepping motor 32, and the reliability of electronic device operation and the reception operation can be improved.

It is also possible to separately provide a detection pulse for detecting external magnetic fields affecting reception of external wireless information, and a detection pulse for detecting external magnetic fields affecting stepping motor drive.

A CPU and memory, for example, can be disposed to the radio-controlled clock so that it functions as a computer, and a specific program can be built in to the computer so that the computer functions as the drive controller, external magnetic field detector, receiver, and storage medium. Because this configuration enables settings to be easily changed, the size of the field-detected external magnetic field, and the reception start and end times for receiving by the receiving circuit 22 can be easily changed.

The specific program can be installed to the computer inside the radio-controlled clock by, for example, directly inserting a memory card, CD-ROM, or other recording medium to the radio-controlled clock, or externally connecting a device for reading such recording media to the radio-controlled clock. In addition, a LAN cable or telephone line, for example, could be connected to the radio-controlled clock for supplying and installing the program by communication.

The present invention is not limited to clock devices, and can be any electronic device having a stepping motor 32 and receiving external wireless information. It can be applied to portable radios, music boxes, cell phones, and a variety of other electronic devices. For example, the results of measuring physical characteristics such as air pressure, gas concentration, voltage, or current could be transmitted as wireless information, and the electronic device could receive the wireless information and drive an indicator by means of a stepping motor to display the measured value on an analog display.

Furthermore, the external wireless information is not limited to time information according to a long wave standard radio signal. For example, the wireless information could be communicated via FM, GPS, Bluetooth, or a contactless IC card, and the content of the external wireless information shall not be limited and could include news or weather report, for example. It will also be obvious that the configuration of the antenna 21 and receiving circuit 22 can be appropriately changed according to the type of signal received.

If the received external wireless information is a weather report, for example, hands could be driven by the stepping motor 32 to indicate predefined information, such as sunny, cloudy, or rain, and if news or stock price information, for example, could be displayed on a liquid crystal display or other such digital display device.

It should be noted that the reception control program can be configured to run on a computer built into an electronic device the same content as in each of the versions of a reception control method for an electronic device. Furthermore, a program can be configured to run on a computer built into an electronic device the same content as in each of the versions of a reception control method for an electronic device, and this program can be recorded to a computer-readable recording medium.

As the foregoing demonstrates, the present invention provides an electronic device, a reception control method for the electronic device, and a reception control program for the electronic device which offer the outstanding effect of being able to accurately receive external wireless information.

While the invention has been described in conjunction with several specific embodiments, further alternatives, modifications, variations and applications will be apparent to those skilled in the art in light of the foregoing description. Thus, the invention described herein is intended to embrace all such alternatives, modifications, variations and applications as may fall within the spirit and scope of the appended claims.

What is claimed is:

1. An electronic device, comprising:

an external wireless information reception unit configured to receive externally-generated wireless information, the external wireless information reception unit comprising an antenna configured to receive externally-generated wireless information, a receiver configured to process externally-generated wireless information received from the antenna, and a storage medium configured to store information received and processed by the receiver a stepping motor unit, comprising a stepping motor, a drive controller configured to control drive of the stepping motor, and an external magnetic field detector configured to detect whether or not an externally-generated magnetic field is present and to output a signal indicative of whether or not an externally-generated magnetic field is detected; and a reception controller configured to control the external wireless information reception unit according to the signal output by the external magnetic field detector.

2. An electronic device as described in claim 1, wherein the stepping motor comprises a drive coil and the external magnetic field detector comprises an induction voltage detector configured to detect an induction voltage induced in the drive coil, and wherein the induction voltage detector detects whether or not an externally-generated magnetic field is present based on whether or not the induction voltage detector detects an induction voltage induced in the drive coil.

3. An electronic device as described in claim 1, wherein the drive controller is configured to control the drive of the stepping motor according to the signal outputted by the external magnetic field detector.

4. An electronic device as described in claim 3, wherein the stepping motor comprises a rotor, and wherein the drive controller comprises a special drive pulse output unit configured to output a special drive pulse with a higher effective value than a normal drive pulse, the special drive pulse being output to rotate the rotor when the signal output by the external magnetic field detector indicates that an externally-generated magnetic field is present.

5. An electronic device as described in claim 1, wherein the reception controller comprises a reception operation prohibiting unit configured to prohibit reception operation by the receiver when the signal output by the external magnetic field detector indicates that an externally-generated magnetic field is present, and a reception operation resuming unit configured to resume reception operation by the receiver when the signal output by the external magnetic field detector indicates that no externally-generated magnetic field is present.

6. An electronic device as described in claim 5, wherein the reception operation resuming unit is configured to resume the reception operation of the receiver a specific time after the signal indicating that an externally-generated magnetic field is not present is received from the external magnetic field detector.

7. An electronic device as described in claim 1, wherein the reception controller comprises a received information invalidation unit configured to invalidate a specific unit of data including externally-generated wireless information received, when the signal output by the external magnetic field detector indicates that an externally-generated magnetic field is present, and a received information validation unit configured to validate data other than the specific unit of data, when the signal output by the external magnetic field detector indicates that an externally-generated magnetic field is present.

8. An electronic device as described in claim 7, wherein the received information validation unit is configured to validate received information from the receiver a specific time after the signal indicating that an externally-generated magnetic field is not present is received from the external magnetic field detector.

9. An electronic device as described in claim 1, wherein the reception controller is configured to execute a reception operation on the receiver a specific number of times when the reception controller receives the signal indicating that an externally-generated magnetic field is not present during the reception operation of the receiver, and add an indication to the externally-generated wireless information that it was influenced by an externally-generated magnetic field and execute a reception operation on the receiver a number of times greater than the specific number of times when the reception controller receives the signal indicating that an externally-generated magnetic field is present during the reception operation of the receiver.

10. An electronic device as described in claim 9, wherein the reception controller is configured to terminate the reception operation of the receiver based on a set schedule information, and disable the reception operation termination process based on the schedule information and repeatedly execute the reception operation on the receiver multiple times when the reception controller receives the signal indicating that an externally-generated magnetic field is present during the reception operation of the receiver.

11. An electronic device as described in claim 1, wherein the externally-generated wireless information comprises a signal transmitted at a constant period, and wherein the external magnetic field detector is configured to detect whether or not an externally-generated magnetic field is present at a desired period according to the period of the externally-generated wireless information signal.

12. An electronic device as described in claim 1, wherein the electronic device is a timepiece device having hands driven by the stepping motor.

13. An electronic device as described in claim 12, wherein the externally-generated wireless information contains time information, and the stepping motor is configured to drive and adjust the hands based on the time information.

14. An electronic device as described in claim 1, wherein the receiver is configured to receive the externally-generated wireless information in a state in which the drive pulse of the drive controller is stopped and an externally-generated magnetic field is being detected by the external magnetic field detector.

15. A reception control method for an electronic device that comprises a stepping motor unit having a stepping motor and an external wireless information reception unit having an antenna for receiving externally-generated wireless information, the reception control method comprising:

detecting whether or not an externally-generated magnetic field is present and outputting a signal indicative of whether or not an externally-generated magnetic field is detected;

processing externally-generated wireless information received from the antenna;

storing received and processed externally-generated wireless information; and controlling at least one of the processing and storing step according to whether the signal outputted indicates that an externally-generated magnetic field is present or not.

16. A reception control program for an electronic device stored in a computer-readable medium and adapted to be executed on a computer integrated with the electronic device that comprises a stepping motor unit having a stepping motor and an external wireless information reception unit having an antenna for receiving externally-generated wireless information, the reception control method comprising:

detecting whether or not an externally-generated magnetic field is present and outputting a signal indicative of whether or not an externally-generated magnetic field is detected;

processing externally-generated wireless information received from the antenna;

storing received and processed externally-generated wireless information; and controlling the external wireless information reception unit according to whether the signal outputted indicates that an externally-generated magnetic field is present or not.

* * * * *